US010520258B2

(12) United States Patent
Liu et al.

(10) Patent No.: US 10,520,258 B2
(45) Date of Patent: Dec. 31, 2019

(54) HEAT EXCHANGER

(71) Applicant: Zhejiang Sanhua Automotive Components Co., Ltd., Hangzhou, Zhejiang (CN)

(72) Inventors: Bo Liu, Zhejiang (CN); Jiang Zou, Zhejiang (CN); Fangfang Yin, Zhejiang (CN); Gang Lv, Hangzhou (CN); Rongrong Zhang, Zhejiang (CN); Yuting Yin, Zhejiang (CN)

(73) Assignee: Zhejiang Sanhua Automotive Components Co., Ltd., Hangzhou, Zhejiang (CN)

( * ) Notice: Subject to any disclaimer, the term of this patent is extended or adjusted under 35 U.S.C. 154(b) by 1 day.

(21) Appl. No.: 16/060,017

(22) PCT Filed: Nov. 28, 2016

(86) PCT No.: PCT/CN2016/107483
§ 371 (c)(1),
(2) Date: Jun. 6, 2018

(87) PCT Pub. No.: WO2017/097133
PCT Pub. Date: Jun. 15, 2017

(65) Prior Publication Data

US 2018/0363988 A1 Dec. 20, 2018

(30) Foreign Application Priority Data

Mar. 31, 2016 (CN) ..... 2016 1 0201884

(51) Int. Cl.
*F28D 9/00* (2006.01)
*F28D 7/08* (2006.01)
(Continued)

(52) U.S. Cl.
CPC ..... *F28D 7/082* (2013.01); *F28F 1/025* (2013.01); *F28F 1/128* (2013.01); *F28F 1/325* (2013.01);
(Continued)

(58) Field of Classification Search
CPC . F28D 7/082; F28D 1/0478; F28D 2021/0068
(Continued)

(56) References Cited

U.S. PATENT DOCUMENTS 10,010,963 B2 7/2018 Tsuji et al.
2011/0209484 A1 9/2011 Krausch et al.
(Continued)

FOREIGN PATENT DOCUMENTS

CN 1285500 A 2/2001
CN 101883964 A 11/2010
(Continued)

OTHER PUBLICATIONS

International Search Report for Application No. PCT/CN2016/107483 dated Mar. 7, 2017.
(Continued)

*Primary Examiner* — Davis D Hwu
(74) *Attorney, Agent, or Firm* — Wolf, Greenfield & Sacks, P.C.

(57) ABSTRACT

A heat exchanger includes a case body and a heat exchange core, a first fluid channel is formed in the case body, a second fluid channel is formed in the heat exchange core, the heat exchange core includes a flat pipe, the second fluid channel is located in the flat pipe, the flat pipe includes a plurality of bending parts and a plurality of flat and straight parts; a first hole in communication with a first connection pipe and a second hole in communication with a second connection pipe are provided in the case body, the first hole partially corresponds to the bending parts on one side of the flat pipe
(Continued)

or the flat and straight parts close to the bending parts, and the second hole partially corresponds to the bending parts on the other side or the flat and straight parts close to the bending parts.

17 Claims, 12 Drawing Sheets

(51) Int. Cl.

| | |
|---|---|
| ***F28F 1/32*** | (2006.01) |
| ***F28F 9/00*** | (2006.01) |
| ***F28F 9/02*** | (2006.01) |
| ***F28F 1/12*** | (2006.01) |
| ***F28F 1/02*** | (2006.01) |
| *F28D 21/00* | (2006.01) |
| *F28D 1/047* | (2006.01) |

(52) U.S. Cl.
CPC ..... *F28F 9/001* (2013.01); *F28F 9/0221* (2013.01); *F28F 9/0243* (2013.01); *F28F 9/0251* (2013.01); *F28F 9/0278* (2013.01); *F28D 1/0478* (2013.01); *F28D 2021/0068* (2013.01); *F28F 1/02* (2013.01); *F28F 2230/00* (2013.01)

(58) Field of Classification Search
USPC ..... 165/163
See application file for complete search history.

(56) References Cited

U.S. PATENT DOCUMENTS

| | | | |
|---|---|---|---|
| 2013/0174924 | A1 | 7/2013 | Luo et al. |
| 2014/0027099 | A1 | 1/2014 | Sispera et al. |
| 2014/0352302 | A1 | 12/2014 | Cho et al. |
| 2015/0107811 | A1 | 4/2015 | Kaestle et al. |

FOREIGN PATENT DOCUMENTS

| | | | |
|---|---|---|---|
| CN | 201652995 | U | 11/2010 |
| CN | 201706938 | U | 1/2011 |
| CN | 103201585 | A | 7/2013 |
| CN | 203100483 | U | 7/2013 |
| CN | 103256757 | A | 8/2013 |
| CN | 203274364 | U | 11/2013 |
| CN | 103868380 | A | 6/2014 |
| CN | 103968698 | A | 8/2014 |
| CN | 104121800 | A | 10/2014 |
| CN | 203980722 | U | 12/2014 |
| CN | 104296422 | A | 1/2015 |
| CN | 204188033 | U | 3/2015 |
| CN | 104583703 | A | 4/2015 |
| CN | 204329704 | U | 5/2015 |
| CN | 104748582 | A | 7/2015 |
| CN | 104949394 | A | 9/2015 |
| CN | 204730525 | U | 10/2015 |
| CN | 201510905980.4 | | 6/2019 |
| DE | 10 2008 043 920 | A1 | 5/2010 |
| EP | 16872324.5 | | 6/2019 |
| JP | S5528476 | A | 2/1980 |
| JP | S58-106394 | A | 6/1983 |
| JP | H09-189463 | A | 7/1997 |
| KR | 20040038328 | A | 5/2004 |
| KR | 10-0725009 | B1 | 5/2007 |
| KR | 10-2013-0085864 | A | 7/2013 |
| KR | 2014-0003857 | A | 1/2014 |
| WO | WO 2009/110664 | A1 | 9/2009 |

OTHER PUBLICATIONS

First Office Action for Chinese Application No. CN201610634384.1, dated Mar. 18, 2019.
First Office Action for Chinese Application No. CN201510906354.7, dated Apr. 1, 2019.
Extended European Search Report for European Application No. 16872324.5, dated Jun. 12, 2019.
Office Action for Chinese Application No. 201510905980.4, dated Jun. 27, 2019.
First Office Action for Chinese Application No. 201510905980.4, dated Jan. 3, 2019.

HEAT EXCHANGER

This application is a national stage filing under 35 U.S.C. 371 of International Patent Application Serial No. PCT/CN2016/107483, filed Nov. 28, 2016, entitled "HEAT EXCHANGER" which claims priority benefits under 35 U.S.C. § 119(a)-(d) or 35 U.S.C. § 365(b) to the following Chinese Patent Applications, the entire contents of these applications are incorporated herein by reference in their entirety:

(1) Chinese Patent Application No. 201510905980.4 titled "HEAT EXCHANGER", filed with the Chinese State Intellectual Property Office on Dec. 9, 2015.

(2) Chinese Patent Application No. 201510906370.6 titled "HEAT EXCHANGER", filed with the Chinese State Intellectual Property Office on Dec. 9, 2015.

(3) Chinese Patent Application No. 201510906354.7 titled "HEAT EXCHANGER", filed with the Chinese State Intellectual Property Office on Dec. 9, 2015.

(4) Chinese Patent Application No. 201610196914.9 titled "HEAT EXCHANGER AND VEHICLE THERMAL MANAGEMENT SYSTEM", filed with the Chinese State Intellectual Property Office on Mar. 31, 2016.

(5) Chinese Patent Application No. 201610201002.6 titled "HEAT EXCHANGER AND VEHICLE AIR-CONDITIONING SYSTEM", filed with the Chinese State Intellectual Property Office on Mar. 31, 2016.

(6) Chinese Patent Application No. 201610201884.6 titled "HEAT EXCHANGER AND $CO_2$ COOLING SYSTEM", filed with the Chinese State Intellectual Property Office on Mar. 31, 2016.

(7) Chinese Patent Application No. 201610196745.9 titled "HEAT EXCHANGER AND VEHICLE THERMAL MANAGEMENT SYSTEM", filed with the Chinese State Intellectual Property Office on Mar. 31, 2016.

(8) Chinese Patent Application No. 201610634384.1 titled "HEAT EXCHANGE DEVICE", filed with the Chinese State Intellectual Property Office on Aug. 3, 2016.

(9) Chinese Patent Application No. 201610629325.5 titled "HEAT EXCHANGE DEVICE", filed with the Chinese State Intellectual Property Office on Aug. 3, 2016.

FIELD

The present application relates to the technical field of heat exchange, and particularly relates to a vehicle heat exchange technology.

BACKGROUND $CO_2$ is a new-type eco-friendly refrigerant, which can reduce the greenhouse effect, and solve the environmental pollution of compound, thus has a good economic and practical performance. A compression-type refrigeration cycle system taking $CO_2$ as working medium can be applied to most refrigeration/heating fields.

However, the $CO_2$ refrigeration system has a high working pressure, and this feature of this type of system is required to be fully taken into account when designing a $CO_2$ heat exchanger, and the design of the components is still immature, as a result, this type of system is not widely used. In general, $CO_2$ heat exchangers are mainly of a finned-tube type, a microchannel type, a plate type, a shell-and-tube type, a finned-plate type, a double-pipe type and so on. The plate type and the finned-plate type are complex in manufacturing process, while tubes of the finned-tube type, the tube-in-tube type and the shell-and-tube type require a relatively large wall thickness, which causes a material waste.

Besides, the conventional $CO_2$ microchannel heat exchanger performs heat exchange by the forced convection between the refrigerant and the air, which has a low efficiency. Although there is a large difference between physical properties of the liquid and the air, and the liquid-air heat exchange has a higher efficiency, the liquid-air heat exchanger has problems of a large wall thickness and a low heat exchange performance.

Therefore, a technical problem to be urgently solved is to provide a heat exchanger that is applicable to the refrigerant system having a relatively high pressure and has a good heat exchange performance.

SUMMARY

In order to solve the technical problems in the conventional technology, a heat exchanger which can effectively solve the technical problems is provided according to the present application.

A heat exchanger is provided according to the present application, including a case body and a heat exchange core accommodated in the case body. A first fluid channel is formed in the case body, a second fluid channel is formed in the heat exchange core, and the first fluid channel and the second fluid channel are isolated from each other, the heat exchange core includes one or more flat pipes, the second fluid channel is located in the flat pipe, and the flat pipe includes at least one first bending portion, at least one second bending portion and a plurality of flat straight portions, the first bending portion and the second bending portion are located at two opposite sides of the heat exchange core, the adjacent two flat straight portions are roughly parallel with each other and keeps a distance of 0.5 mm to 6 mm from each other; and the case body is provided with a first hole and a second hole both in communication with outside, the projection of the first bending portion and/or the part close to the first bending portion of the flat straight portions in the direction of the inner wall of the case body is at least partially coincident with the first hole or an opening of the first hole at the case body; and the projection of the second bending portion and/or the part close to the second bending portion of the flat straight portions in the direction of the inner wall of the case body is at least partially coincident with the second hole or an opening of the second hole at the case body.

The heat exchanger in the above technical solution can enable a coolant to contact with most part of the outer wall of the flat pipes, thus can increase an effective heat exchange area of the heat exchanger. In addition, a flow direction of the coolant is roughly the same as or opposite to a flow direction of a refrigerant, and the flow directions of the coolant and the refrigerant with respect to a position of the flat straight portions are roughly parallel or antiparallel, thus can improve a heat exchange performance between the refrigerant and the coolant, and can effectively improve the heat exchange performance of the heat exchanger.

DETAIL DESCRIPTION

Embodiments of the present application are illustrated hereinafter in conjunction with the drawings.

Figure 1:
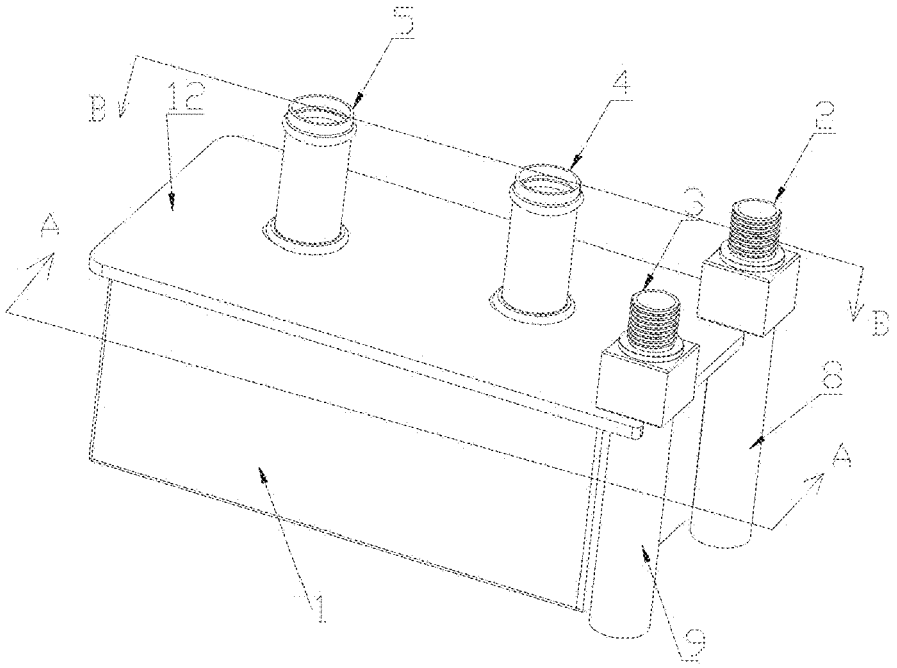
FIG. 1 is a schematic perspective view showing a heat exchanger according to an embodiment of the present application.
Figure 2:
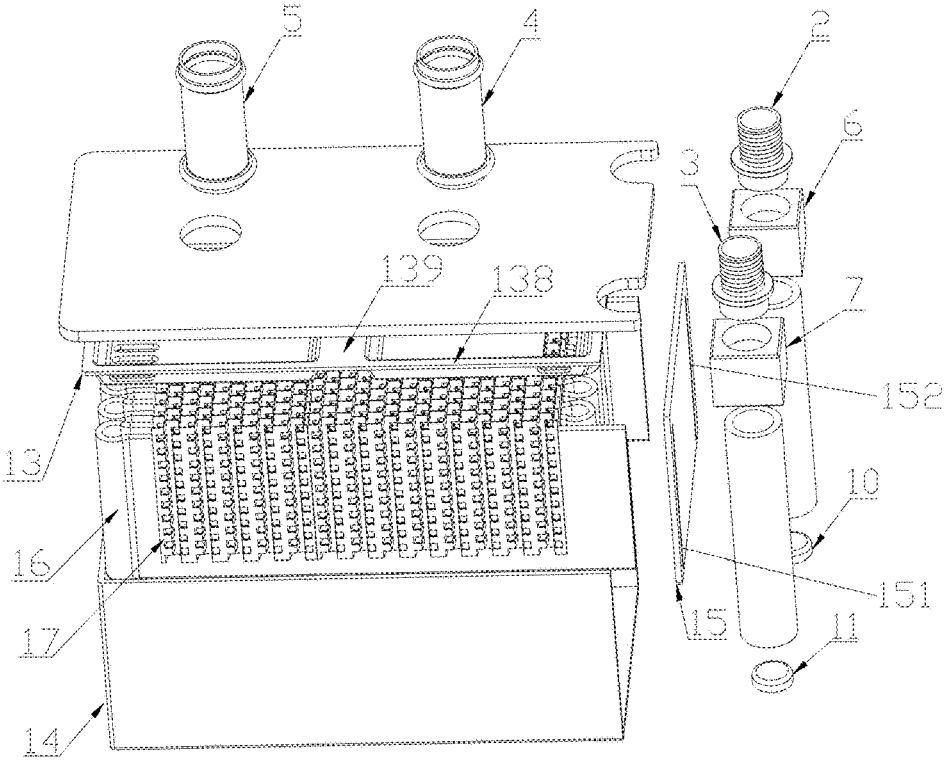
FIG. 2 is an exploded schematic view of the heat exchanger in FIG. 1.
Figure 3:
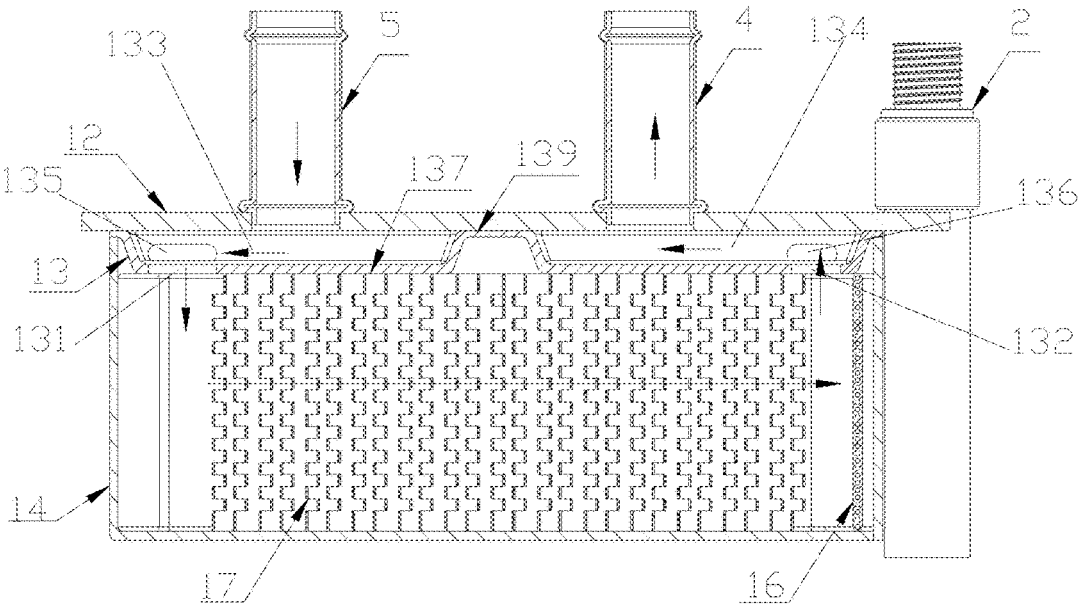
FIG. 3 is a sectional view showing the heat exchanger in FIG. 1 taken along B-B.
Figure 4:
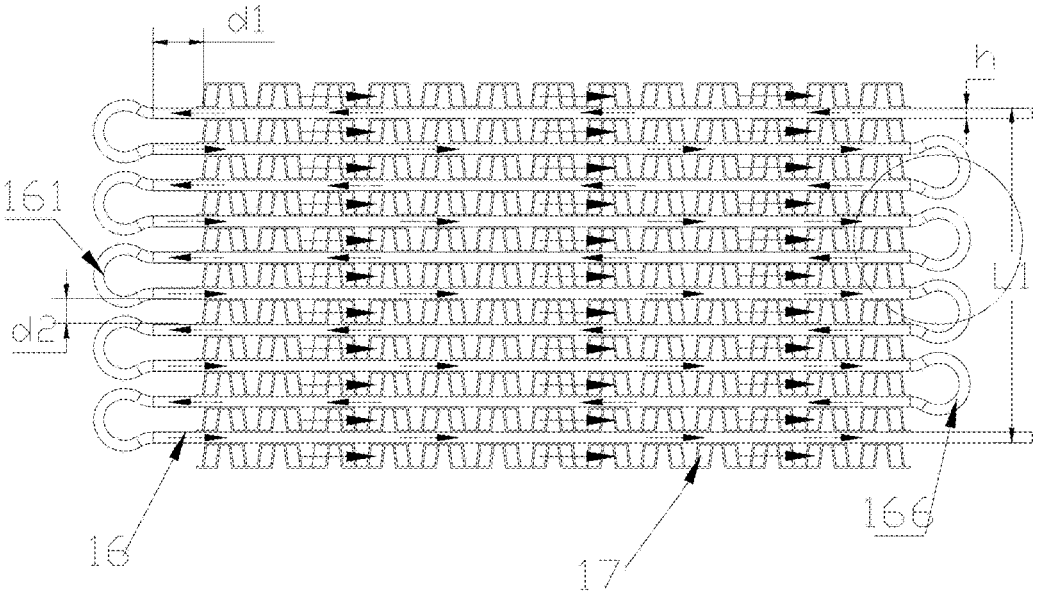
FIG. 4 is a sectional view showing an assembly of flat pipes and fins of the heat exchanger in FIG. 1 taken along A-A.
Figure 5:
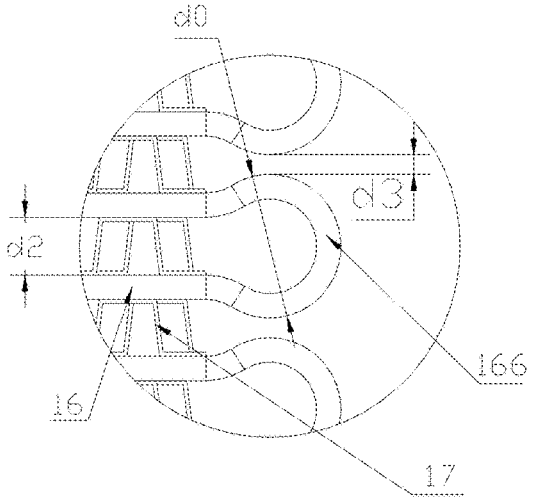
FIG. 5 is a partially enlarged schematic view of FIG. 4.
Figure 6:
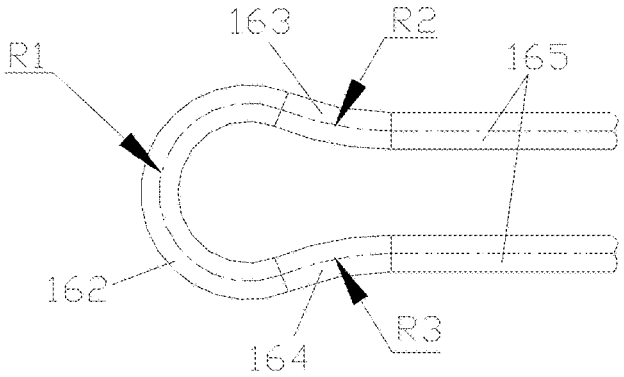
FIG. 6 is a schematic view showing the partial structure of the flat pipe in FIG. 4 at a bending position.

FIG. 1 is a schematic perspective view showing a heat exchanger according to an embodiment of the present application, FIG. 2 is an exploded schematic view of the heat exchanger in FIG. 1. As shown in FIGS. 1 and 2, in this embodiment, the heat exchanger includes a case body 1 and a heat exchange core accommodated in the case body 1. A first fluid channel is formed in the case body, and a second fluid channel is formed in the heat exchange core. An outside of the heat exchange core is a part of the first fluid channel, and the first fluid channel and the second fluid channel are isolated from each other. A first connecting pipe 5 and a second connecting pipe 4 both in communication with the first fluid channel are fixedly arranged to the case body 1. It should be noted that, those skilled in the art can understand that, a space outside the heat exchange core includes a space between flat pipes, a space between flat pipes and fins, and a space in the fins, etc.

The case body 1 includes a main case body 14, a first cover plate 12, a distributing plate 13 and a second cover plate 15. The main case body 14 is approximately a cuboid or cube having two surfaces each being provided with an opening end, the two surfaces of the main case body 14 where the two opening ends are located are adjacently arranged. One opening end is seal-fixed by the main case body 14 and the second cover plate 15 through welding or the like, and the distributing plate 13 and the first cover plate 15 are arranged at another opening end in sequence from inside to outside, starting from the main case body.

Figure 8:
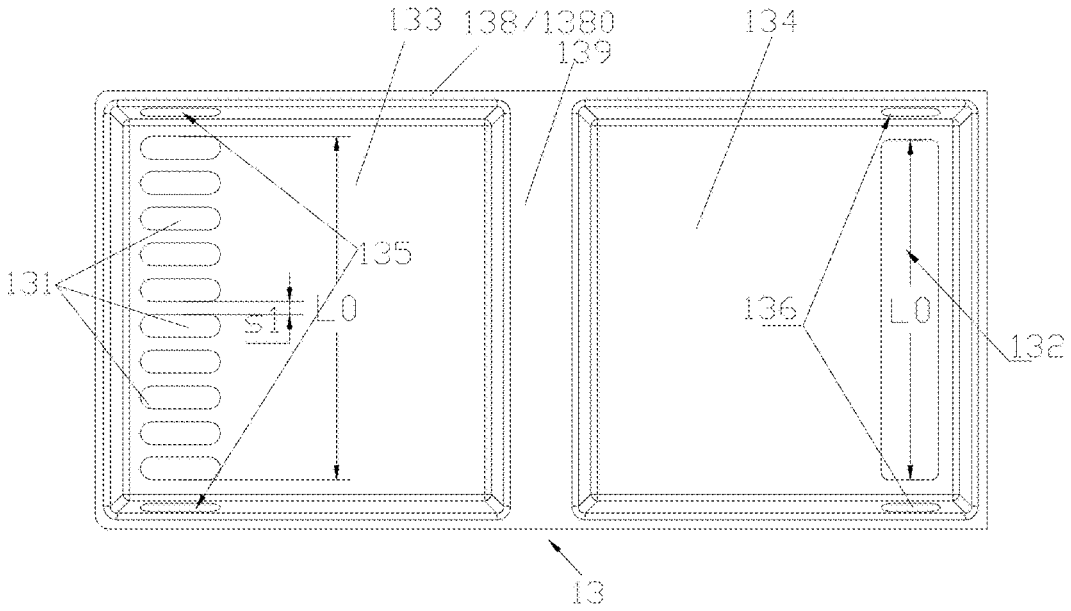
FIG. 8 is a schematic view showing the structure of a distributing plate of the heat exchanger in FIG. 1.
Figure 9:
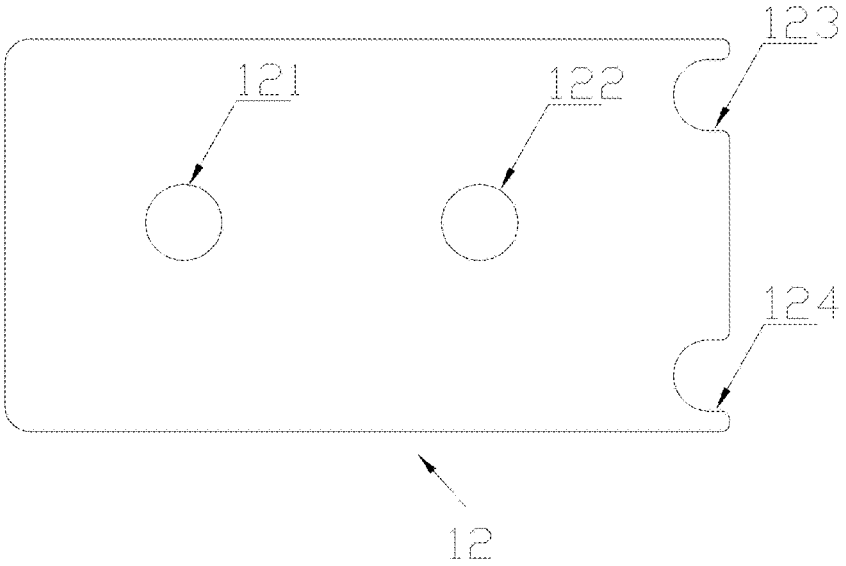
FIG. 9 is a schematic view showing the structure of a first cover plate of the heat exchanger in FIG. 1.

As shown in FIG. 8, the distributing plate 13 includes a plane portion 138, and a first groove 133 and a second groove 134 both concaved downward from the plane portion 138, which allows two bosses to be formed at another side of the distributing plate 13, so that the first groove 133 has an inner wall and an outer wall, and the second groove 134 also has an inner wall and an outer wall. The first groove 133 and the second groove 134 are isolated from each other and adjacently arranged. The plane portion 138 includes an isolating portion 139 and a matching portion 1380 on a periphery of the plane portion, a region of the isolating portion 139 between the first groove 133 and the second groove facing the first cover plate 12 134 is aligned to a region of the matching portion 1380 facing the first cover plate 12, and a planeness of the plane portion 138 is within 0.1 mm. In addition, the isolating portion 139 may have a concave portion, thus the isolating portion between the first groove 133 and the second groove 134 is divided into two parts of separating regions aligned with the plane portion, which makes the separation between the first groove 133 and the second groove 134 more reliable. Edges of opening ends of the first groove 133 and the second groove 134 maintain a certain distance from an edge of the distributing plate 133, so that the periphery of the plane portion 138 of the distributing plate 13 has a certain width to form the matching portion 1380, and the width of the matching portion 1380 on the periphery of the plane portion is larger than a wall thickness of the main case body 14. The inner wall of the first groove 133 may have a certain slope, so that an area of an opening of the first groove 133 is larger than an area of a bottom surface of the first groove 133, and a sectional area of the first groove 133 gradually decreases from the opening to the bottom surface of the first groove 133. The inner wall of the second groove 134 may also have a certain slope, so that an area of an opening of the second groove 134 is larger than an area of a bottom surface of the second groove 134, and a sectional area of the second groove 134 gradually decreases from the opening to the bottom surface of the second groove 134.

A bottom of the first groove 133 may be provided with one or more distributing holes 131, a side wall of the first groove 133 may also be provided with a first communicating hole 135, and the first communicating hole 135 is arranged close to the distributing holes 131, the distributing holes 131 can serve as first holes. A bottom of the second groove 134 is provided with one or more converging holes 132, a side wall of the second groove 134 may also be provided with a second communicating hole 136, and the second communicating hole 136 is arranged close to the converging holes 132, and the converging holes 132 can serve as second holes. One flat pipe is provided in this embodiment, the flat pipe includes multiple flat straight portions 165 located relatively in the middle, multiple first bending portions 161 located relatively at one side, and multiple second bending portions 166 located relatively at another side. The first bending portions 161 are relatively close to the distributing holes 131, and the second bending portions 166 are relatively close to the converging holes 132. In the heat exchanger, the distributing holes and the converging holes correspondingly match with the bending portions of the flat pipe, or, the distributing holes and the converging holes correspondingly match with finless regions close to the bending portions and/or he bending portions of the flat pipe; or in other words, a projection of the first bending portions of the flat pipe and/or the finless region close to the first bending portions in the direction of the distributing plate is at least partially coincident with the distributing holes, a projection of the second bending portions of the flat pipe at another side of the heat exchange core and/or the finless region close to the second bending portions in the direction of the distributing plate is at least partially coincident with the converging holes. By arranging multiple distributing holes 131, the fluid can be more evenly distributed, thus improving the heat exchange performance of the heat exchanger.

A first surface and a second surface of the plane portion 138 of the distributing plate 13 are located at one plane respectively, and one plane here refers to that the planeness of the surface is within 0.1 mm. The second surface facing the main case body of the distributing plate 13 is seal-fixed to the opening end of the main case body 14 by welding, bolt connection and the like. As shown in the figure, in this embodiment, a top surface facing the distributing plate of the main case body 14 in the Figure is arranged as an opening, the matching portion at a periphery of the second face of the plane portion 138 facing the main case body and a side wall of the main case body 14 are connected to each other and may be seal-fixed to each other by welding and the like, and the outer wall of the first groove 133 keeps a certain distance from an inner wall of the case body 14. Since the inner wall of the first groove 133 has a certain slope, a part of the fluid can smoothly passes through the first communication holes 135 from the first groove 133, and flows into the main case body 14. Similarly, the outer wall of the second groove 134 keeps a certain distance from the inner wall of the case body 14. Since the inner wall of the second groove 134 has a certain slope, a part of the fluid can smoothly passes through the second communication holes 136 from the second groove 134, and flows into the main case body 14. In this way, the fluid can also flow at a side wall of the heat exchange core close to the case body 1, which can increase an effective heat exchange area of the heat exchanger, thus improving the performance of the heat exchanger.

A width H of the flat pipe is equal to or slightly smaller than a distance between a bottom 137 of the two grooves of the distributing plate and a bottom wall inside the case body, a difference between the distance between the bottom 137 of the grooves and the bottom wall inside the case body and the width H of the flat pipe is smaller than 3 mm. In a case that there are multiple distributing holes, a space S1 between two adjacent distributing holes is smaller than a space d2 between two adjacent flat straight portions, and a length L0 of a region of the distributing plate where the distributing holes are arranged is larger than or equal to a distance L1 between the two flat straight portions farthest from each other minus twice a thickness h of the flat pipe: L0>L1−2 h; further, the length L0 of the region of the distributing plate where the distributing holes are arranged is larger than the distance L1 between the two flat pipes farthest from each other, in this way, an inner side and an outer side of any one of the bending portions and the flat straight portions of the flat pipe can exchange heat with the fluid directly, which makes the liquid distribution relatively even, and the heat exchange area larger. In addition, taking the issues of assembly and the like into account, the length L0 of the region of the distributing plate where the distributing holes are arranged may be smaller than or equal to the distance L1 between the two flat pipes farthest from each other plus four times the thickness h of the flat pipe: L0<L1+4 h. In a case that there is one distributing hole, the length of the region of the distributing plate where the distributing hole is arranged is the length L0 of the distributing hole, and the length L0 of the distributing hole is larger than or equal to the distance between the two flat pipes farthest from each other in a flat pipe group minus twice the thickness of the flat pipe. In other words, the length of the distributing hole enables the distributing hole to cover the inner sides of the bending portions of any flat pipes or an interspace between any adjacent flat straight portions; in addition, the arrangement of the first communicating hole enables an outmost end space of the flat pipes to be in communication via the first communicating hole, thus a space between any adjacent flat pipes can be in communication with at least one distributing hole, making the fluid distribution meet the requirement of the system. Besides, the first communicating hole may not be provided, and the length L0 of the region of the distributing plate where the distributing holes are arranged is set to be larger than the distance L1 between the two flat pipes farthest from each other plus four times the thickness h of the flat pipe, thus a space communicated via the distributing holes can include the inner sides and the outer sides of any bending portions and flat straight portions of the flat pipes or a space between any group of adjacent flat straight portions. Correspondingly, a position where the distributing hole is arranged is relatively close to the side of the distributing plate and corresponds to the first bending portions of the flat pipe and the region close to the first bending portions where fins are not provided; correspondingly, a position where the first communicating hole is arranged corresponds to the first bending portions of the flat pipe and/or the region close to the first bending portions where fins are not provided, in other words, projections of the bending portions of the flat pipe and/or the region close to the first bending portions where fins are not provided in the direction of the distributing plate is partially coincident with the distributing hole; besides, the position where the first communicating hole is arranged is relatively close to the distributing hole, so as to improve the distribution uniformity and the heat exchange effect.

The first cover plate 12 matches with the distributing plate 13, the first cover plate 12 partially covers the distributing plate 13, the first surface of the distributing plate 13 facing the first cover plate 12 basically fit the first cover plate 12 and is fixed to the first cover plate 12 by welding, which enables the first groove 133 and the second groove 134 to respectively form a first chamber and a second chamber isolated from each other. The first cover plate 12 is provided with a first through hole 121 and a second through hole 122, wherein the first through hole 121 corresponds to the first groove 133, the second through hole 122 corresponds to the second groove 134. A projection of the first through hole 121 onto the bottom surface of the first groove 133 keeps a certain distance from the distributing hole 131, so as to avoid the problem of nonuniform fluid distribution caused by the fluid rushing to the distributing hole 131 when flowing from the first through hole 121 into the first groove 133. A projection of the second through hole 122 onto the bottom surface of the second groove 134 also keeps a certain distance from the converging hole 132. The first through hole 121 is fitted and seal-fixed to the first connecting pipe 5, the second through hole 122 is fitted and seal-fixed to the second connecting pipe 4, and a hole of the first connecting pipe serves as the first hole, and a hole of the second connecting pipe serves as the second hole. The first cover plate 12 is further provided with a first clamping groove 123 and a second clamping groove 124 for limiting a position, a shape of the groove may be a semi-circular shape or a substantially U shape.

Moreover, bottom areas of the first groove 133 and the second groove 134 are relatively large, the distributing hole 131 is arranged at a side of the bottom surface of the first groove 133 away from the second groove 134, while other parts of the bottom surface are not provided with the distributing hole; similarly, the converging hole 132 is arranged at a side of the bottom surface of the first groove 133 away from the first groove 133, while other parts of the bottom surface are also not provided with the distributing hole; the distributing hole 131 and the converging hole 132 are located relatively far away from each other on the distributing plate 13, so that a flowing path of the fluid in the heat exchange core is relatively large, thereby sufficient heat exchange of the fluid in the heat exchange core can be ensured. Moreover, the distributing plate 13 and the first cove plate are fitted, and because of the above structural feature, a region where the first through hole 121 and the second through hole 122 of the first cover plate 12 can be arranged is large. And since the region where the first through hole and the second through hole can be arranged is large, positions of the first through hole 121 and the second through hole 122 and a distance between the first through hole 121 and the second through hole 122 can be set according to the requirement of the system.

Figure 13:
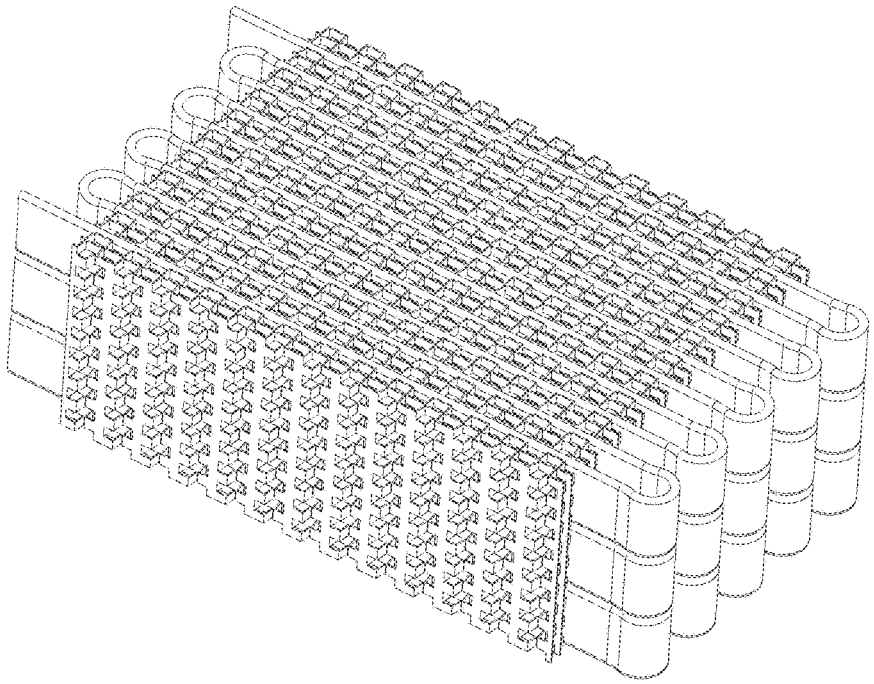
FIG. 13 is a schematic view showing the structure of a heat exchange core of the heat exchanger having multiple flat pipes arranged side by side.

As shown in FIGS. 2 to 6, the heat exchange core is arranged in a region between the distributing plate 13 of the case body 1 and the bottom of the main case body 14. The heat exchange core includes a flat pipe 16 having a section roughly of a serpentine shape and multiple fins 17. It should be noted that, the number of the flat pipe 16 is not limited to one, and multiple flat pipes arranged side by side may be provided, as shown in FIG. 13. In the case that one flat pipe 16 is provided, the width of the flat pipe 16 is relatively large, and in order to improve the heat exchange performance of the heat exchanger, the width of the flat pipe 16 should be substantially equal to or slightly smaller than the distance between the distributing plate 13 and the bottom of the main case body 14. Channels in the flat pipe 16 can be arranged to be multiple channels in parallel with each other, and the channels define the second fluid channel.

Multiple flat straight portions 165, multiple first bending portions 161 and multiple second bending portions 166 are formed by bending the flat pipe 16. The first bending portions 161 and the second bending portions 166 are located at two opposite sides of the heat exchange core, the multiple flat straight portions 165 are substantially parallel with respect to each other, and a certain distance d2 is maintained between two adjacent flat straight portions 165, where the value of d2 ranges from 0.5 mm to 6 mm. Most of the fins 17 are located at a space between the adjacent flat straight portions 165, the fins 17 may be zigzag fins, and may also be fins of other types, such as dimpled fins, twisted fins, fins having punched holes, spiral coil, flat straight fins and the like. In a part corresponding to the distributing hole 131, an end of the fins 17 close to the first bending portion 161 may keep a certain distance d1 from the first bending portion 161, where the value of d1 ranges from 5 mm to 30 mm. In this way, a part of an end of the flat straight portions 165 close to the first bending portions 161 is not provided with the fins, therefore a flow resistance of the fluid at this part is small, the fluid can flow along a width direction of the first bending portions and the part of the flat straight portions 165 without fins, which enables the fluid in the space between any group of adjacent flat straight portions to be uniformly distributed in the space or along the width direction of the flat pipe; then, the fluid flows along a length direction of the flat straight portions 165 between adjacent flat pipes, so as to avoid a problem that the fluid close to the distributing plate has a relatively large flow quantity, thus improving the distribution uniformity of the fluid in the width direction of the flat pipe, thereby improving the heat exchange performance of the heat exchanger.

A composite layer is provided on the fins 17, and the fins 17 and the flat pipe 16 can be fixed together by brazing and the like. Besides, the fins 17 and the distributing plate 13 can be fixed by brazing, and the fins 17 and an inner wall of the main case body 14 opposite to the distributing plate 13 can be fixed by brazing. In this way, the heat exchange core can be fixed in the case body 1, thereby improving the stability of the heat exchanger.

As shown in the figure, looking down from a top, the first bending portion 161 includes multiple sections of circular arcs connected smoothly, and the first bending portion 161 includes a main bending portion 162, a first subsidiary bending portion 163 and a second subsidiary bending portion 164. An end of the first subsidiary bending portion 163 and an end of the second subsidiary bending portion 164 at a same side are connected to two adjacent flat straight portions 165 respectively, and the first subsidiary bending portion 163 and the second subsidiary bending portion 164 are connected to two ends of the main bending portion 162 respectively. The main bending portion 162 is located between the first subsidiary bending portion 163 and the second subsidiary bending portion 164. A radius of a circular arc of the main bending portion 162 is R1, a radius of a circular arc of the first subsidiary bending portion 163 is R2, and a radius of a circular arc of the second subsidiary bending portion 164 is R3, where R2 may be equal to R3, and R1<d2<2 R1. A diameter d0 of the circular arc of the main bending portion 162 is larger than the distance d2 between two adjacent flat straight portions, therefore on the one hand, the distance between two adjacent flat straight portions is relatively small, and also the reliability of the bending manufacturing of the flat pipe is ensured, so that fins with a relatively small height can be employed to improve the heat exchange performance of the heat exchanger; on the other hand, a distance d3 between two adjacent first bending portions 161 can be maintained relatively small, which enables the fluid to flow smoothly in a region between two adjacent first bending portions 161, and prevents two adjacent first bending portions 161 from abutting together to block the flowing of the fluid, thereby improving the heat exchange performance of the heat exchanger. The structure of the second bending portion 166 may be referred to the first bending portion 161, of course, the second bending portion and the first bending portion may also be of other structures. For example, the second bending portion includes multiple sections of circular arcs connected smoothly, the second bending portion includes a main bending portion and a subsidiary bending portion, two ends of the subsidiary bending portion are connected to the main bending portion and the flat straight portion respectively, two ends of the main bending portion are connected to the subsidiary bending portion and the flat straight portion relatively, an end of the main bending portion connected to the flat straight portion is tangent to the flat straight portion, and the diameter of the circular arc of the main bending portion is larger than the distance between two adjacent flat straight portions.

In this way, in the heat exchanger, a fluid flow channel is formed between two adjacent flat straight portions, the fins arranged between two adjacent flat straight portions can improve the turbulence performance of the fluid, thereby improving the heat exchange performance of the heat exchanger. In addition, the diameter d0 of the circular arc of the main bending portion 162 is larger than the distance d2 between two adjacent flat straight portions, thus enabling the fluid to contact with most part of the flat pipe and even almost the whole outer surface thereof. The fluid in the flat pipe 16 and the fluid outside the flat pipe 16 not only can perform heat exchange through the flat straight portions 165, but also can perform heat exchange through the bending portions, thus increasing the effective heat exchange area of the flat pipe 16, and further improving the heat exchange performance of the heat exchanger.

As shown in the figure, the heat exchanger further includes a first collecting pipe 8 and a second collecting pipe 9 which are respectively in communication with the flow channels inside the flat pipe 16. One end of the flat pipe 16 passes through a first matching hole 152 of the second cover plate 15 and extends into the first collecting pipe 8, and the flat pipe 16 and the first collecting pipe 8 are seal-fixed to each other. Another end of the flat pipe 16 passes through a second matching hole 151 of the second cover plate 15 and extends into the second collecting pipe 9, and the flat pipe 16 and the second collecting pipe 9 are seal-fixed to each other. The first matching hole 152 matches with the flat pipe 16, and the first matching hole 152 and the flat pipe 16 can be seal-fixed by welding; the second matching hole 151 matches with the flat pipe 16, and the second matching hole 151 and the flat pipe 16 can be seal-fixed by welding. The first collecting pipe 8 and the second collecting pipe 9 are clamped in the first clamping groove 123 and the second clamping groove 124 respectively for position limiting. Besides, the first collecting pipe 8 and the second collecting pipe 9 can also be respectively fixed by welding to fixed adapters, the adapters can be fixed to the first cover plate by welding, and the first collecting pipe 8 and the second collecting pipe 9 can be fixed to the adapters by welding. The stability of the heat exchanger can be improved by welding fixing.

In this embodiment, one end of the first collecting pipe 8 is sealed by a first end cover 10, and another end of the first collecting pipe 8 is connected to a first adapter 6, the first adapter 6 is connected to and in communication with a third connecting pipe 2, and the third connecting pipe 2 can be in communication with an inner chamber of the first collecting pipe 8 through the first adapter 6. Similarly, one end of the second collecting pipe 9 is sealed by a second end cover 11, and another end of the second collecting pipe 9 is connected to a second adapter 7, the second adapter 7 is connected to and in communication with a fourth connecting pipe 3, and the fourth connecting pipe 3 can be in communication with an inner chamber of the second collecting pipe 9 through the second adapter 7. By arranging the adapters, connecting pipes with different specifications, inner diameters and outer diameters can be arranged conveniently, thus facilitating the fitting of the heat exchanger with the system.

An operation manner of the heat exchanger in this embodiment is shown hereinafter.

The refrigerant flows into the first collecting pipe 8 from the third connecting pipe 2, and then flows into the flat pipe 16 extending into the first collecting pipe. The flat pipe 16 includes one refrigerant flow channel or multiple refrigerant flow channels substantially in parallel with each other, the refrigerant flows through the flow channel of the flat pipe 16 and performs heat exchange with the coolant inside the case body 1. The refrigerant after heat exchange flows into the collecting pipe 9, and then flows out of the heat exchanger through the fourth connecting pipe 3.

The coolant flows into the first groove 133 from the first connecting pipe 5, the fluid flowing into the first groove 133 flows into the case body 1 via the distributing hole 131 or via the distributing hole 131 and the first communicating hole 135. Since at least a part of a portion corresponding to the distributing hole and the first communicating hole in the case body is not provided with the fins, the fluid can be basically evenly distributed in the portion where the first bending portions are arranged and the finless region close to the first bending portions of the flat pipe at this end of the case body. Most of the coolant first flows along the width direction of the first bending portions and the flat pipe close to the first bending portions, and then flows along a length direction of the flat straight portions 165. At this time, the coolant can contact with most of the outer wall of the flat pipe 16, the coolant exchanges heat with the refrigerant in the flat pipe 16. The coolant after heat exchange flows into the second groove 134 via the converging hole 132 or via the converging hole 132 and the second communicating hole 136, and then flows out of the heat exchanger via the second collecting pipe 4. In this embodiment, the heat exchange core is relatively hermetically arranged inside the case body, the coolant is outside the flat pipe of the heat exchange core, therefore most of the flat pipes can be effectively used, thus the effective heat exchange area of the heat exchanger is increased, and the heat exchange performance of the heat exchanger can be improved.

Figure 7:
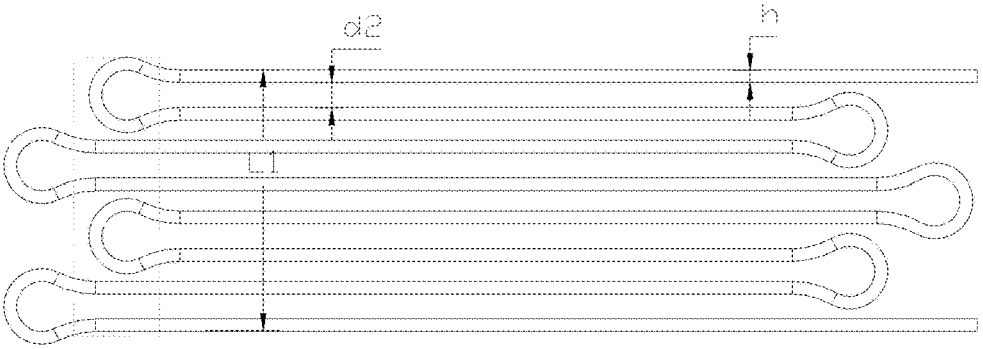
FIG. 7 is a schematic view showing the structure of the flat pipe having adjacent bending portions arranged in a staggered manner.

In order to further reduce the distance between the flat straight portions of two adjacent flat pipes, and meanwhile ensure that two adjacent bending portions do not interfere with each other, as shown in FIG. 7, two adjacent bending portions can also be arranged in a staggered manner, and specifically, among multiple bending portions of the flat pipe located at one side of the case body, two adjacent bending portions are not aligned to each other, but are staggered, thus can relatively reduce the distance between adjacent flat pipes. Besides, a minimum distance between adjacent two bending portions is larger than a minimum distance between the bending portion and the flat straight portion which are adjacent. Correspondingly, the distributing holes are arranged to ensure that the inner sides of the bending portions of any flat pipe or a space between adjacent flat straight portions close to the bending portions can be directly in communication with the distributing holes, that is, looking down from the top, at least one distributing hole has a part located at the inner side of the bending portion relatively at the inner side or located between the flat straight portions of the finless region close to the bending portions of the flat pipe; and at least one distributing hole has a part located in any bending portion relatively at the outer side or located between the flat straight portions of the finless region close to the bending portions of the flat pipe. The distributing holes are arranged to ensure that a space between any adjacent flat pipes can be in communication with the distributing holes, that is, looking down from the top, at least one distributing hole has a part located at an outer side of the bending portion relatively at the inner side or an outer side of the flat straight portions of the finless region close to the bending portions of the flat pipe, and an outer side of the bending portion relatively at an outer side or an outer side of the flat straight portions of the finless region close to the bending portions of the flat pipe. Dashed boxes in the Figure schematically shows an embodiment of a rough range of communication of the distributing holes.

Figure 10:
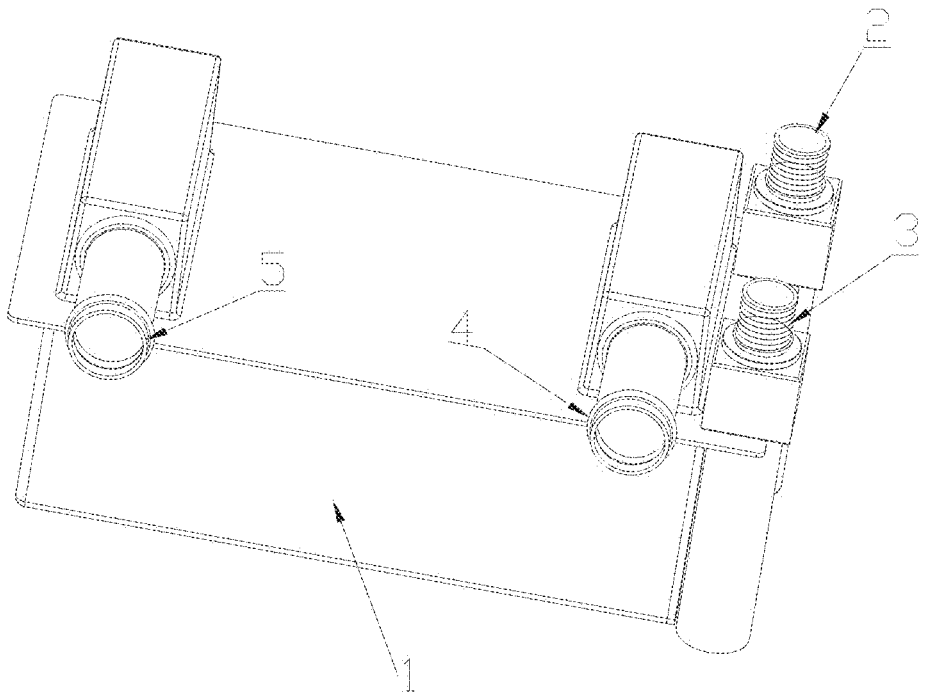
FIG. 10 is a schematic perspective view showing a heat exchanger according to another embodiment of the present application.
Figure 11:
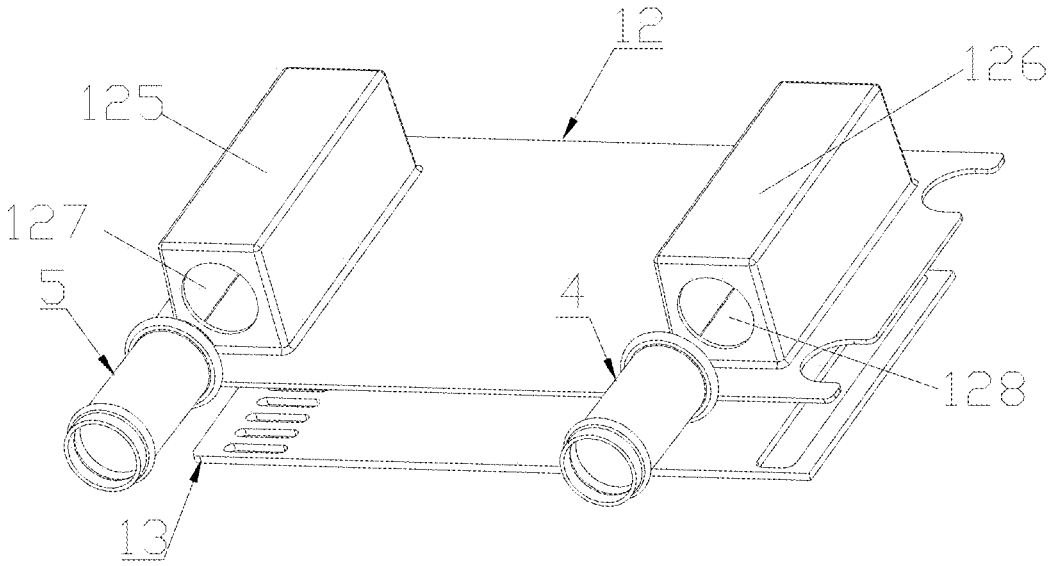
FIG. 11 is an exploded schematic view of a first cover plate and a distributing plate in the embodiment in FIG. 10.

FIGS. 10 and 11 show another embodiment according to the present application, in this embodiment, the distributing plate 13 is not provided with the first groove and the second groove. The distributing plate 13 is a flat plate, and is provided with one or more distributing holes and one or more converging holes. Correspondingly, the first cover plate 12 is provided with a first chamber 125 and a second chamber 126 each having an opening at one end. An opening end of the first chamber 125 corresponds to the distributing holes 131, and an opening end of the second chamber 126 corresponds to the converging holes. The first chamber 125 is in communication with the first connecting pipe 5, and the second chamber 126 is in communication with the second connecting pipe 4. In this embodiment, a side wall of the first chamber 125 is provided with a first connecting opening 127 configured to connect to the first connecting pipe 5, and the first connecting opening 127 is opened in a direction which is the same as a direction in which the distributing holes 131 are arranged side by side. Besides, a communicating area of the distributing holes close to the first connecting opening 127 may be smaller than the communicating area of distributing holes away from the first connecting opening 127, or, the communicating areas of the distributing holes gradually increase in a direction away from the first connecting opening 127. In this way, when the fluid flows from the first connecting opening 127 into the first chamber 125, a flow quantity in a region away from the first connecting opening 127 is approximately equal to the flow quantity in a region close to the first connecting opening 127. By arranging the distributing holes having different communicating areas, the coolant can flow relatively uniformly to a side of the case body, and further flows relatively uniformly through the heat exchange core, thereby improving the heat exchange performance of the heat exchanger. Besides, this manner can prevent the problem of nonuniform distribution of the fluid caused by the fluid directly impacting the distributing holes. In addition, the distributing holes may be of a same size, nonetheless, by arranging the side having a relatively large distributed flow quantity close to an inlet side of the flat pipe, the heat exchange effect is relatively better. In a case that there are multiple distributing holes, a space S1 between two adjacent distributing holes is smaller than a space d2 between two adjacent flat pipes, in this way, the inner side and the outer side of any bending portion of the flat pipe can be directly in communication with at least one distributing hole, making the fluid distribution more uniform. And, the length L0 of the region of the distributing plate where the distributing holes are arranged is larger than the distance L1 between the two flat pipes farthest from each other plus two times the thickness h of the flat pipe, and a length of the distributing holes is set to enable the distributing holes to communicate with the inner sides of the bending portions of any flat pipe and communicate with the outer sides of the bending portions. In a case that there is one distributing hole, the length of the distributing hole is larger than the distance L1 between the two flat pipes farthest from each other of the flat pipe group plus two times the thickness h of the flat pipe, the length of the distributing holes is set to enable the distributing hole to communicate with the inner sides of the bending portions of any flat pipe and communicate with the outer sides of the bending portions, or in other words, to communicate with both sides of any flat pipe. In this way, the inner side and the outer side of any bending portion of the flat pipe can be directly in communication with at least one distributing hole, making the fluid distribution meet the requirement of the system. In the same way, the arrangement of the converging holes is similar, the number of the converging hole may be one, a length of the converging hole is larger than the distance L1 between two flat pipes farthest from each other in the flat pipe group plus two times the thickness h of the flat pipe, and the length enables the converging hole to communicate with the inner sides of the bending portions of any flat pipe and communicate with the outer sides of the bending portions; multiple converging holes may be provided. In a case that the distributing plate is provided with the first connecting hole, the length L0 of the region of the distributing plate where the distributing holes are arranged or the length L0 of the region where the converging holes are arranged is larger than the distance L1 between the two flat pipes farthest away from each other minus two times the thickness h of the flat pipe. Further, the length L0 of the region of the distributing plate where the distributing holes are arranged or the length L0 of the region where the converging holes are arranged is smaller than or equal to the distance L1 between the two flat pipes farthest from each other plus four times the thickness h of the flat pipe: $L0<L1+4$ h, which ensures that the fluid can flow through two sides of any flat pipe to better perform heat exchange.

In this embodiment, a side wall of the second chamber 126 can also be provided with a second connecting opening 128 in communication with the second connecting pipe 4, and opening directions of the first connecting opening 127 and the second connecting opening 128 are coincident, which facilitates the installation of the first connecting opening and the second connecting opening.

Figure 12:
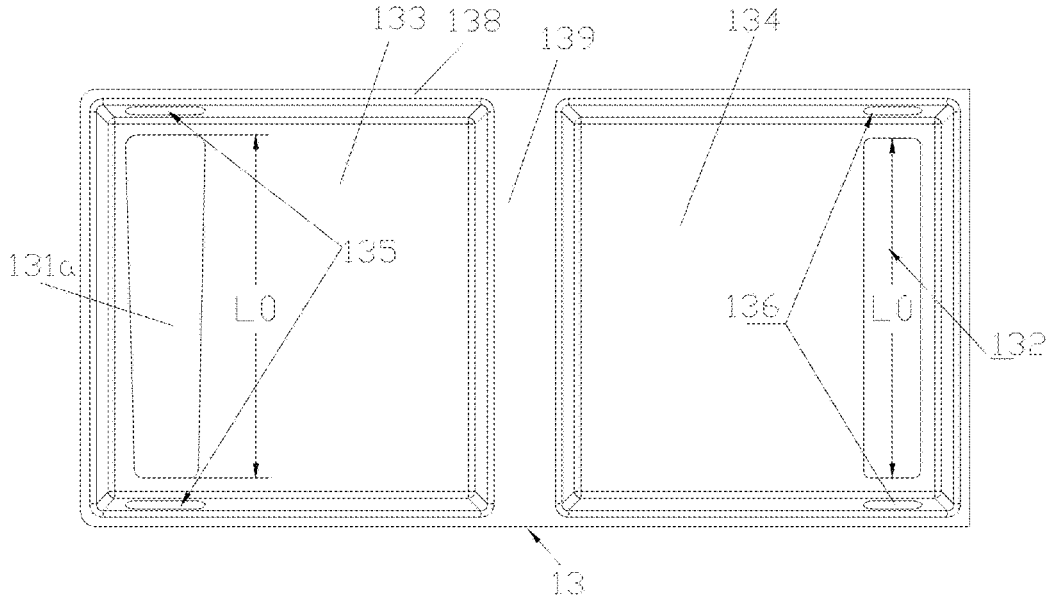
FIG. 12 is a schematic view showing another structure of the distributing plate of the heat exchanger.

It should be noted that, the distributing plate may not be provided in the embodiment, while the distributing holes and the converging holes are arranged in a wall of the first chamber facing the case body. Other structures and the operation manners are the same as or similar to the above embodiment, which are not be described herein. FIG. 12 is a schematic view shows another structure of the distributing plate of the heat exchanger. In the above embodiment, the distributing holes are of the same size, allowing the fluid to be distributed substantially uniformly between every two adjacent flat pipes. Besides, the refrigerant flows in from one end of the flat pipe and flows out via another end of the flat pipe, the heat required to be exchanged by the flat pipe close to the inlet end is relatively more, while the heat required to be exchanged by the flat pipe close to the outlet end is relatively less, therefore, the coolant can be distributed according to the requirements, thus the heat exchange effect will be relatively better. As shown in the figure, the distributing hole 131*a* is arranged to have a structure having one relatively large end and another relatively small end, a width of the distributing hole relatively close to the inlet side is arranged to be larger than the width of the distributing hole relatively close to the outlet side, and a wider side of the distributing hole is arranged to be close to a side corresponding to a refrigerant inlet, which makes the heat exchanger efficiency relatively better. Of course, in a case that multiple distributing holes are arranged, an area of the distributing holes relatively close to the inlet side of the flat pipe may be arranged to be larger than the area of the distributing holes at another side, and the side having a relatively large area is arranged to be close to the side corresponding to the refrigerant inlet.

It should be noted that, the first chamber and the second chamber may not be located at the same side of the case body, and may be located at two opposite sides of the case body. In this case, the converging holes and the second groove are located at a side of the case body opposite to a side of the case body where the distributing holes and the first groove are located, and the specific structures of the converging holes, the second groove, the distributing holes and the first groove and the relationships therebetween and the heat exchange core are the same as or similar to the above embodiment, which are not be described herein.

Figure 14:
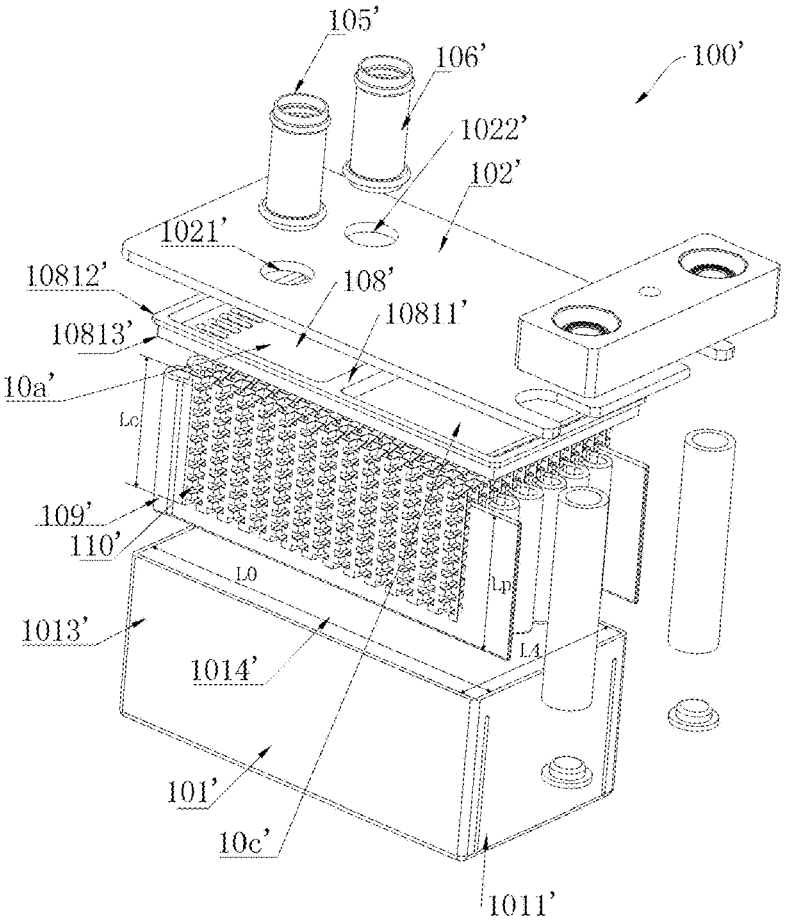
FIG. 14 is an exploded schematic view showing a heat exchanger according to yet another embodiment of the present application.
Figure 15:
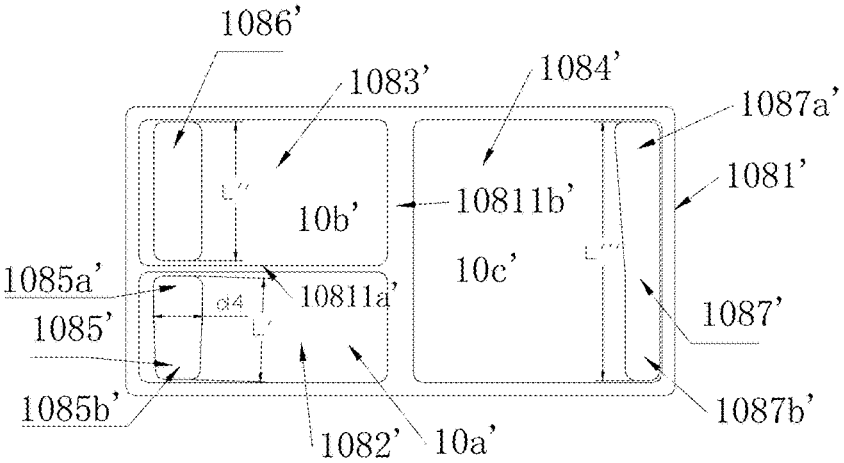
FIG. 15 is a schematic view showing a distributing plate of the heat exchanger in FIG. 14.
Figure 19:
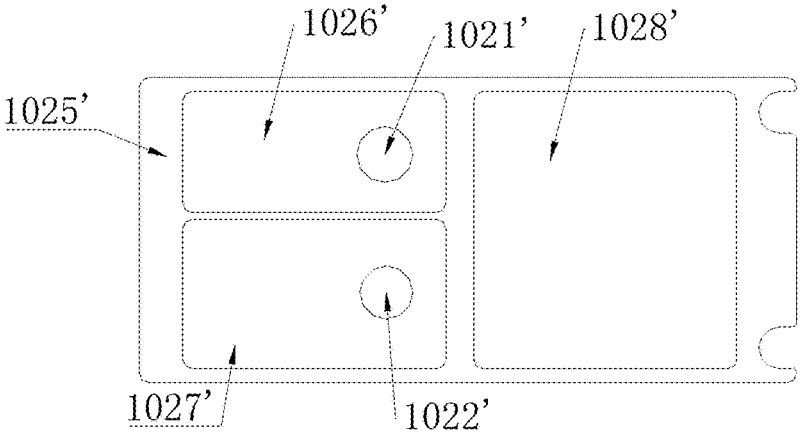
FIG. 19 is a schematic bottom view showing an embodiment of a cover plate of the heat exchanger in FIG. 14.

FIGS. 14 and 19 show another embodiment of the heat exchanger according to the present application. As shown in FIGS. 14 and 15, in this embodiment, the heat exchanger 100' includes a case body and a heat exchange core accommodated in the case body. A first fluid channel is formed in the case body, a second fluid channel is formed in the heat exchange core, the first fluid channel is located outside a part of the heat exchange core, and the first fluid channel and the second fluid channel are isolated from each other. A first fluid in the first fluid channel is for example a cooling liquid, the second fluid in the second fluid channel is for example a refrigerant. A flow direction of at least a part of the first fluid along the length direction of the flat pipe is opposite to a flow direction of the other part of the first fluid along the length direction of the flat pipe.

Different from the above embodiment, the case body includes a main case body 101", the main case body 101" includes a side portion 1011', and the heat exchanger does not need a second cover plate.

Figure 16:
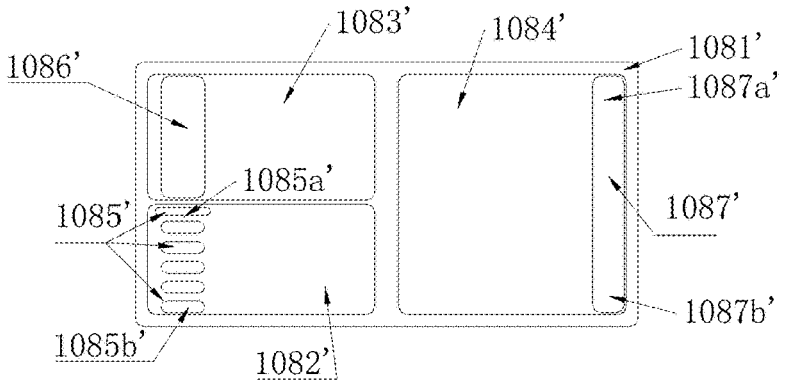
FIG. 16 is a schematic view showing another distributing plate of the heat exchanger in FIG. 14.

As shown in FIG. 16, the distributing plate 108" may include one or more first communicating portion 1085", one or more second communicating portion 1086" and one or more third communicating portion 1087". The first communicating portion 1085", the second communicating portion 1086" and the first bending portions are located at a side relatively close to the first bending portions of the case body. The third communicating portion 1087" and the second bending portions are located at a side relatively away from the first bending portions of the case body. At least three chambers are formed between a cover plate 102" and a distributing plate 108", the chambers are isolated from one another. The chambers include a first chamber **10*a*", a second chamber 10*b*" and a third chamber 10*c*". The first chamber 10*a*" is in communication with the first communicating portion 1085", the second chamber 10*b*" is in communication with the second communicating portion 1086", and the third chamber 10*c*" is in communication with the third communicating portion 1087". The first communicating portion 1085', the second communicating portion 1086' and the third communicating portion 1087' can ensure the chambers between the cover plate 102' and the distributing plate 108' to be in communication with a chamber formed in the main case body 101', so as to allow the fluid to flow in these chambers. The first communicating portion 1085' and a part of the third communicating portion 1087' are in communication through a part of the first fluid channel, and another part of the third communicating portion 1087' and the second communicating portion 1086' are in communication through another part of the first fluid channel. The first fluid enters into an outer region of the flat pipe inside the case body through the first communicating portion, next enters into the third chamber 10*c*' through a part of the third communicating portion, and then enters into an outer region of other flat pipes inside the case body through another part of the third communicating portion 1087'**, and then enters into the second chamber through the second communicating portion. In this way, a flow path of the first fluid inside the main case body can be prolonged, which facilitates the improvement of the heat exchange effect.

A first connecting opening 1021' on the cover plate 102' is located at a position corresponding to the first chamber **10*a*', and is in communication with the first chamber. The second connecting opening 1022' is located at a position corresponding to the second chamber 10*b*', and is in communication with the second chamber. A projection of the first connecting opening 1021' on the distributing plate 108' is not coincident with the first communicating portion 1085', and a distance between the projection of the first connecting opening 1021' on the distributing plate 108' and the first communicating portion 1085' is not smaller than ⅛ of a length L' of the first communicating portion 1085' along a width direction of the heat exchange core. Or, the distance between the projection of the first connecting opening on the distributing plate and the first communicating portion is not smaller than ⅛ of a sum L' of lengths of two or more first communicating portions along a width direction of the heat exchange core; a projection of the second connecting opening 1022' onto the distributing plate 108' is not coincident with the second communicating portion 1086', and a distance between the projection of the second connecting opening 1022' on the distributing plate 108' and the second communicating portion 1086' is not smaller than ⅛ of a length L" of the second communicating portion 1086' along a width direction of the heat exchange core, or, the distance between the projection of the second connecting opening on the distributing plate and the second communicating portion is not smaller than ⅛ of a sum L' of lengths of two or more second communicating portions along a width direction of the heat exchange core. In this way, the first fluid entering from the first connecting opening 1021' can be relatively better distributed to the first communicating portion 1085'**, so as to prevent the fluid from collectively flowing in a few channels, which may adversely affect the heat exchange performance.

In this embodiment, the distributing plate 108' includes a plane portion 1081', and a first groove 1082', a second groove 1083' and a third groove 1084 all concaved downward from the plane portion 1081'. Thus, three bosses are formed at another side of the distributing plate 108', or in other words, a side of the distributing plate 108' close to the main case body includes a stepped portion 10813', and the stepped portion 10813' is located inside the main case body and is fixed to an inner wall of the main case body. The grooves are isolated from one another and are arranged adjacently, the first groove 1082' and the second groove 1083' are located at one side of the distributing plate 108', and the third groove 1084' is located at another opposite side of the distributing plate 108'. The plane portion 1081' includes an isolating portion 10811' and an edge portion 10812' on a periphery of the plane portion. A region of the isolating portion 10811' facing the cover plate 102' is level with a region of the edge portion 10812' facing the cover plate, and a planeness of the plane portion 1081' is within 0.1 mm. The isolating portion 10811' includes a first isolating portion 10811*a*' and a second isolating portion 10811*b*'. The first isolating portion 10811*a*' is located between the first groove 1082' and the second groove 1083', and the second isolating portion 10811*b*' is located both between the third groove and the first groove and between the third groove and the second groove. A width of the first isolating portion 10811*a*' should not be too large and is relatively smaller than a width of the second isolating portion 10811*b*', a width of the first isolating portion in the width direction of the heat exchange core maybe smaller than a distance d1 between adjacent flat straight portions 1093' of the flat pipe, so as to prevent the fluid from being blocked by the first isolating portion, which causes the waste of the heat exchange area. Edges of opening ends of the first groove 1082', the second groove 1083' and the third groove 1084' keep a certain distance from an edge of the distributing plate 108', so that the periphery of the plane portion 1081' of the distributing plate 108' has a certain width to form the edge portion 10812'. The edge portion 10812' includes a front side and a back side, the front side is fixed to the cover plate and the back side is fixed to a wall of the case body 101', and a distance extending outward from the stepped portion 10813' of the reverse side is larger than a thickness of the wall of the case body 101'. A region of the edge portion 10812 facing the cover plate 102" and a region of the isolating portion 10811' facing the cover plate 102' are both seal-fixed to the cover plate 102' by manners like welding, a region of the edge portion 10812' opposite to the cover plate 102' and the wall of the case body 101' are seal-fixed by manners like welding.

As shown in FIG. 15, the first communicating portion 1085' is located in the first groove 1082' (for example, the first communicating portion is located at a bottom of the first groove 1082'), and the first chamber 10*a*' is formed between the first groove 1082' and the cover plate. The second communicating portion 1086' is located in the second groove 1083' (for example, the second communicating portion is located at a bottom of the second groove 1083'), and the second chamber 10*b*' is formed between the second groove 1083' and the cover plate. The third communicating portion 1087' is located in the third groove 1084' (for example, the third communicating portion is located at a bottom of the third groove 1084'), and the third chamber 10*c*' is formed between the third groove 1084' and the cover plate. The first communicating portion 1085' and the second communicating portion 1086' are roughly aligned to each other in position, and both are close to a side of the distributing plate 108' where the edge portion 10812' is located. The third communicating portion 1087' is close to another side of the distributing plate 108' opposite to the edge portion 10812', and a distance between a side of the first communicating portion 1085' and the second communicating portion 1086' close to the edge portion 10812' and a side of the third communicating portion 1087' close to the edge portion 10812' is roughly equal to a length of the flat pipe 109', thus the flow path of the fluid in the first fluid channel can be relatively large, thereby ensuring the relatively sufficient heat exchange between the fluid in the first channel and the fluid in the second channel. The length L' of the first communicating portion 1085' in the width direction of the heat exchange core or the sum L' of the lengths of two or more first communicating portions in the width direction of the heat exchange core is smaller than or equal to a length L" of the second communicating portion 1086' in the width direction of the heat exchange core or a sum L" of the lengths of two or more second communicating portions in the width direction of the heat exchange core. A length L'" of the third communicating portion 1087' in the width direction of the heat exchange core or a sum L'" of the lengths of two or more third communicating portions in the width direction of the heat exchange core is larger than the length L" of the second communicating portion 1086' in the width direction of the heat exchange core or the sum L" of the lengths of two or more second communicating portions in the width direction of the heat exchange core. The length L'" of the third communicating portion 1087' in the width direction of the heat exchange core or the sum L'" of the lengths of two or more third communicating portions in the width direction of the heat exchange core is larger than the length L' of the first communicating portion 1085' in the width direction of the heat exchange core or the sum L' of the lengths of two or more first communicating portions in the width direction of the heat exchange core. And the length L'" of the third communicating portion 1087' in the width direction of the heat exchange core or the sum L'" of the lengths of two or more third communicating portions in the width direction of the heat exchange core may be equal to or slightly smaller than a distance L3 between the fins farthest away from each other. In this way, the first fluid just flowing into the heat exchange can be distributed between more flat straight portions of the flat pipe through the first communicating portion 1085', and a flow rate of the fluid between the flat straight portions of adjacent flat pipes increases, making the heat exchange between the first fluid and the second fluid more sufficient, which facilitates the improvement of the heat exchange effect.

Figure 17:
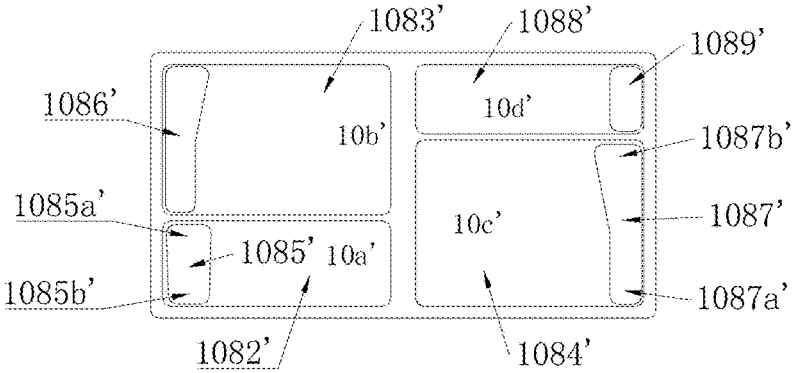
FIG. 17 is a schematic view showing yet another distributing plate of the heat exchanger in FIG. 14.

The second fluid flows in via a second collecting pipe 104' and flows out via a first collecting pipe 103'. The first fluid from the first connecting opening 1021' flows into an inner chamber of the case body through the first communicating portion 1085', and flows out of the inner chamber of the case body from the second communicating portion 1086'. As shown in FIG. 17, there is one first communicating portion 1085', and a width of the first communicating portion 1085' in the length direction of the pipe gradually decreases along a direction from the second chamber to the first chamber, or a width of an end 1085*a*' of the first communicating portion 1085' close to the second communicating portion 1086' is larger than a width of an end 1085*b*' of the first communicating portion 1085' away from the second communicating portion 1086'. And/or there is one third communicating portion 1087', and a width of the third communicating portion 1087' gradually decreases along the direction from the second chamber 10*b*' to the first chamber 10*a*', or widths of two ends of the third communicating portion 1087' are different, a width of an end 1087*a*' of the third communicating portion 1087' corresponding to the second communicating portion 1086' is larger than an end 1087*b*' of the third communicating portion 1087' corresponding to the first communicating portion 1085'. In this way, in the main case body, a direction in which the first fluid moves from one side to another side of the case body along the width direction of the heat exchange case body is opposite to a direction in which the second fluid moves from one side to another side of the case body along the width direction of the heat exchange case body, so that the two fluids can exchange heat with each other better. Besides, by setting different widths of the first communicating portion 1085', more first fluid is allowed to exchange heat with the fluid relatively close to the inlet side of the second fluid, which facilitates the improvement of the heat exchange effect.

As shown in FIG. 16, it may also be arranged in a way that two or more first communicating portions 1085' are located in the first groove 1082' (for example the bottom), a projection of each first communicating portion 1085' in the direction of the flat pipe is located between adjacent flat straight portions of the flat pipe, a length of the first communicating portion 1085' in the width direction of the heat exchange core is roughly equal to the distance d1 between adjacent flat straight portions of the flat pipe. In this way, the fluid in the first chamber 10*a'* can be better distributed between adjacent flat straight portions, making the fluid distribution more even, which facilitates the improvement of the heat exchange effect. Of course, the projection of each first communicating portion 1085' in the direction of the flat pipe is only required to partially fall in between adjacent flat straight portions of the flat pipe In the above embodiment, three chambers are formed between the distributing plate 108' and the cover plate 102', the first fluid flows from the first chamber 10*a'* and flows into the main case body, the fluid changes the direction after flowing through the third chamber 10*c'* and flows out of the second chamber 10*b'*. The second fluid channel is two-flow-path.

In addition, the second fluid channel may be three-flow-path or four-flow-path, for example, as shown in FIG. 17, the distributing plate 108' includes the first communicating portion 1085', the second communicating portion 1086', the third communicating portion 1087' and a fourth communicating portion 1089'. Four chambers are formed between the distributing plate 108' and the cover plate 102', the chambers include the first chamber 10*a'*, the second chamber 10*b'*, the third chamber 10*c'*, and a fourth chamber 10*d'*. The first chamber 10*a'* is in communication with the first communicating portion 1085', the second chamber 10*b'* is in communication with the second communicating portion 1086', the third chamber 10*c'* is in communication with the third communicating portion 1087', and the fourth chamber 10*d'* is in communication with the fourth communicating portion 1089'. The first communicating portion 1085' and the second communicating portion 1086' are located at one side of the distributing plate 108', and the third communicating portion 1087' and the fourth communicating portion 1089' are located at another side of the distributing plate 108'. The first connecting opening 1021' in the cover plate 102' is located at a position corresponding to the first chamber 10*a'*, and the second connecting opening 1022' in the cover plate 102' is located at a position corresponding to the fourth chamber 10*d'*. The first communicating portion 1085', the second communicating portion 1086' and a first bending portion 1091' are located at one side of the main case body, and the third communicating portion 1087', the fourth communicating portion 1089' and a second bending portion 1092' are located at a side of the main case body relatively away from the first bending portion 1091'. The first connecting opening 1021' and the first communicating portion 1085' are in communication with each other through the first chamber 10*a'*, the first communicating portion 1085' and a part of the third communicating portion 1087' are in communication with each other through a part of the first fluid channel, a part of the third communicating portion 1087' and another part of the third communicating portion 1087' are in communication with each other through the third chamber 10*c'*, and another part of the third communicating portion 1087' and a part of the second communicating portion 1086' are in communication with each other through another part of the first fluid channel; a part of the second communicating portion 1086' and another part of the second communicating portion 1086' are in communication with each other through the second chamber 10*b'*, another part of the second communicating portion 1086' and the fourth communicating portion 1089' are in communication with each other through another part of the first fluid channel, the fourth communicating portion 1089' is in communication with the fourth chamber 10*d'*, and the second connecting opening 1022' is in communication with the fourth chamber 10*d'*.

More specifically, the first communicating portion, the second communicating portion, the third communicating portion and the fourth communicating portion are located at the bottom of the distributing plate 108'. The distributing plate includes the first groove 1082', the second groove 1083', a third groove 1084' and a seventh groove 1088'. The first groove 1082' and the second groove 1083' are located at one side of the distributing plate 108', and the third groove 1084' and the seventh groove 1088' are located at another side of the distributing plate 108' which is opposite. The length of the first communicating portion in the width direction of the heat exchange core or the sum of the lengths of two or more first communicating portions in the width direction of the heat exchange core is smaller than or equal to the length of the second communicating portion in the width direction of the heat exchange core or a sum of the lengths of two or more second communicating portions in the width direction of the heat exchange core. The length of the third communicating portion in the width direction of the heat exchange core or a sum of the lengths of two or more third communicating portions in the width direction of the heat exchange core is larger than a length of the fourth communicating portion in the width direction of the heat exchange core or the sum of the lengths of two or more fourth communicating portions in the width direction of the heat exchange core. The second communicating portion and the third communicating portion have a part overlapped in the width direction of the heat exchange core, the first communicating portion and the third communicating portion have a part overlapped in the width direction of the heat exchange core, and the second communicating portion and the fourth communicating portion have a part overlapped in the width direction of the heat exchange core. In this way, the first fluid in the first chamber flows into the main case body through the first communicating portion, and along a fin region between the flat straight portions of the flat pipe, the first fluid flows from a part of the third communicating portion into the third chamber, and then flows into the main case body through another part of the third communicating portion; the fluid changes the direction to flow through the fin region between the flat straight portions of the flat pipe, then flows into the second chamber 10*b'* through a part of the second communicating portion, the fluid in the second chamber 10*b'* then flows into the main case body through another part of the second communicating portion; the fluid changes the direction again to flow through the fin region between the flat straight portions of the flat pipe, and flows into the fourth chamber 10*d'* through the fourth communicating portion. In this way, the first fluid channel can be called as three-flow-path, thus the first fluid can better exchange heat with the second fluid in the flat pipe, and the heat exchange efficiency can be improved when the case body has a relatively small configuration structure.

The above embodiment shows that the distributing plate has multiple grooves, and the multiple grooves and the cover plate match to form multiple chambers. Of course, the cover plate may have multiple grooves, the multiple grooves on the cover plate together with the distributing plate form multiple chambers. For example, as shown in FIG. 19, the cover plate 102' includes a second plane portion 1025', and a fourth groove 1026', a fifth groove 1027' and a sixth groove 1028' concaved downward from the second plane portion 1025'. The first chamber 10*a*' is formed by the fourth groove 1026' and the bottom of the distributing plate 108', the second chamber 10*b*' is formed by the fifth groove 1027' and the bottom of the distributing plate 108', and the third chamber 10*c*' is formed by the sixth groove 1028' and the bottom of the distributing plate 108'. The second plane portion 1025' is seal-fixed to one side of the distributing plate by manners like welding.

Figure 18:
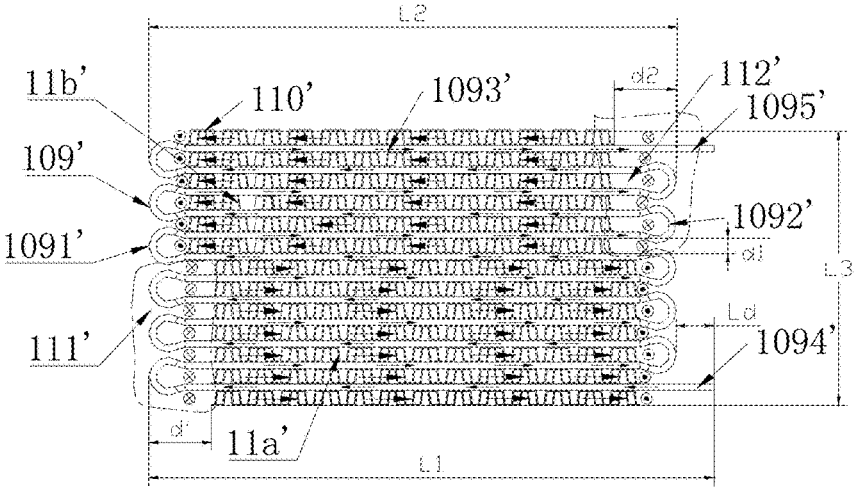
FIG. 18 is a schematic view showing flat pipes and fins inside a main case body of the heat exchanger in FIG. 14; wherein dashed lines roughly describe example areas and do not constitute a limit in shapes.

In order to allow the first fluid from the chambers between the distributing plate and the cover plate to be better distributed to a surface of the flat pipe, referring to FIG. 18, a space between adjacent flat straight portions 1093' of the flat pipe includes a first region 111' corresponding to a position of the first communicating portion 1085', a second region 112' corresponding to a position of the second communicating portion 1086' and a third region 113' corresponding to a position of the third communicating portion 1087'. The first region 111' is a finless region, and an end of fins 110' close to the first region 111' may keep a certain distance d3 from the first bending portions 1091', where the value of d3 ranges from 5 mm to 30 mm. And the distance d3 between the end of fins 110' close to the first region 111' and the first bending portions 1091' is larger than a width d4 in the length direction of the flat pipe of the first communicating portion 1085', the width d4 is just an example, and in a case that the width of the first communicating portion 1085' in the length direction of the flat pipe varies, d4 represents a maximum value. In this way, since an end of the flat straight portions 1093' close to the first bending portion 1091' is not provided with the fins, the flow resistance of the fluid in this region is relatively small, therefore, the fluid can first flow in a width direction of the first bending portion and the finless region of the flat straight portions 1093', allowing the fluid in a space between any adjacent flat straight portions 1093' to be roughly evenly distributed in the space or in the width direction of the flat pipe. And then the fluid flows from the first bending portions 1091' towards the second bending portions 1092' or a first end portion 1094' or a second end portion 1095', so as to avoid the problem that the fluid under the distributing plate 108' and close to the side of the distributing plate 108' has a relatively large flow quantity, thus improving the distribution uniformity in the width direction of the flat pipe of the fluid, thereby improving the heat exchange performance of the heat exchanger. Similarly, in the third region 113', a part 113*a* corresponding to the second region 112' in the length direction of the flat pipe is a finless region, an end close to the part 113*a* of fins 110' may maintain a certain distance d2 from the second bending portions 1092', wherein a value of d2 ranges from 5 mm to 30 mm, so as to make the fluid having entered the part 113*a*' from a part of the third communicating portion 1087' flow smoothly in the width direction of the flat pipe, allow the fluid to enter spaces between flat portions more evenly, and improve the distribution uniformity in the width direction of the flat pipe of the fluid, thereby improving the heat exchange performance of the heat exchanger.

In this embodiment, the second fluid channel is located in the flat pipe, which is applicable to a high-pressure refrigerant system having a relatively high working pressure. The heat exchanger in this embodiment can be applied to a heat management system of a vehicle or an air-conditioning system of the vehicle. The vehicle includes an electric vehicle or an oil-fueled vehicle or a hybrid vehicle. For example, the fluid in the first fluid channel is a cooling liquid, the fluid in the second fluid channel is a high-pressure refrigerant, including (but not limited to) supercritical carbon dioxide, subcritical carbon dioxide and the like.

Other structures and features in this embodiment are the same as or similar to those in the above embodiment, which thus are not be described herein.

FIGS. 20 to 29 show another embodiment of the present application. As shown in the figures, in this embodiment, the heat exchanger includes a housing 7" having an opening side, a first connecting block 2", a second connecting block 3", a mounting plate 4" and a heat exchange core partially or wholly accommodated in the housing 7". The mounting plate 4" is fixedly mounted to the opening side of the housing 7" and covers an opening of the shell, and a first fluid channel is formed in the heat exchange core.

The heat exchange core includes at least one flat pipe 5". The heat exchanger is further provided with a first connecting opening 21" and a second connecting opening 22", and the first connecting opening 21" and a second connecting opening 22" are located at the first connecting block 2". Two ends of the flat pipe 5" are in communication with the first connecting opening 21" and a second connecting opening 22" respectively, so that the first fluid channel is in communication with the first connecting opening 21" and the second connecting opening 22" respectively. The housing 7" is further provided with a third connecting opening 71" and a fourth connecting opening 72". A chamber is formed in the housing, the heat exchange core is partially or wholly accommodated in the chamber, the third connecting opening and the fourth connecting opening are in communication with the chamber, and the first fluid channel is isolated from the chamber.

Figure 21:
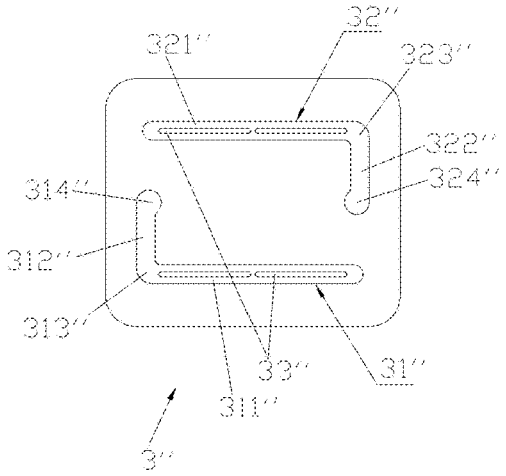
FIG. 21 is a schematic view showing the structure of a second connecting block of the heat exchanger in FIG. 20.

As shown in FIG. 21, the second connecting block 3" is provided with a first channel 31" and a second channel 32", the first channel 31" and the second channel 32" are concaved from a side surface facing the first connecting block 2" of the second connecting block 3". The first channel 31" includes a first straight channel 311", a second straight channel 312", a bending portion 313" located between the first straight channel 311" and the second straight channel 312", and a bubble-shaped end 314" located at an end of the second straight channel 312" away from the bending portion 313". The second channel 32" also includes a first straight channel 321", a second straight channel 322", a bending portion 323" located between the first straight channel 321" and the second straight channel 322", and a bubble-shaped end 324" located at an end of the second straight channel 322" away from the bending portion 323". The second connecting block 3" is further provided with a first socket hole 33" of the first channel which corresponds to the first straight channel 311" of the first channel 31", and a first socket hole 33" of the second channel which corresponds to the first straight channel 321" of the second channel 32". The flat pipe 5" is in a clearance fit with the first socket hole 33", one end of the flat pipe 5" can pass through the first socket hole 33" of the second channel 32" and another end of the flat pipe can pass through the first socket hole 33" of the first channel 31", and the flat pipe 5" and the first socket holes 33" can be fixedly mounted to each other by manners like welding. The end of the flat pipe extending into the first socket hole of the first channel at least partially extends into the first straight channel of the first channel or is in communication with the first straight channel of the first channel. The end of the flat pipe extending into the first socket hole of the second channel at least partially extends into the first straight channel of the second channel or is in communication with the first straight channel of the second channel. In order to ensure the stability of the mounting between the flat pipe 5" and the first socket holes 33", a depth of the first socket hole 33" is larger than or equal to 2 mm. It should be noted herein that, a clearance between the flat pipe 5" and the first socket hole 33" can be filled by a melted welding material during welding, so that the flat pipe 5" and the first socket hole 33" are hermetically mounted to each other.

Inner diameters or equivalent inner diameters of the bubble-shaped end portions 314" and 324" are larger than widths of the second straight channels 312" and 322". Besides, the bubble-shaped end portion 314" of the first channel 31" corresponds to the first connecting opening 21", the inner diameter or the equivalent inner diameter of the bubble-shaped end portion 314" of the first channel 31" is roughly larger than or equal to an inner diameter or an equivalent inner diameter of a part of the first connecting opening 21" close to the bubble-shaped end portion 314" of the first channel 31". The bubble-shaped end portion 324" of the second channel 32" corresponds to the second connecting opening 22", the inner diameter or the equivalent inner diameter of the bubble-shaped end portion 324" of the second channel 32" is roughly larger than or equal to an inner diameter or an equivalent inner diameter of a part of the second connecting opening 22" close to the bubble-shaped end portion 324" of the second channel 32". In this way, a local sudden shrinkage resistance generated during the processes that the fluid flows from first connecting opening 21" to the second straight channel 312" of the first channel 31" and from the second straight channel 322" of the second channel 32" to the second connecting opening 22" can be effectively reduced, thereby reducing the pressure drop loss of the fluid effectively.

By arranging the second straight channel 312" and the bending portion 313" in the first channel 31, and keeping a distance between the bending portion 313" of the first channel 31" and the first socket hole 33" of the first channel 31", the fluid flows in from the first connecting opening 21", then passes through the second straight channel 312" and the bending portion 313" in sequence and flows into tiny fluid channels inside the flat pipe 5", which prevents the fluid from directly rushing to the flat pipe 5" when flowing in from the first connecting opening 21", so as to alleviate the problem of distribution nonuniformity of the fluid in each tiny fluid channel in the flat pipe 5", thereby improving the heat exchange performance of the heat exchanger.

Similarly, by arranging the second straight channel 322" and the bending portion 32 in the second channel, and keeping a distance between the bending portion 323" of the second channel 32" and the first socket hole 33" of the second channel 32", the fluid first passes through the bending portion 323" and the first socket hole 33", then flows to the second connecting opening 22", making flow resistances of the fluid when flowing from each tiny fluid channel of the flat pipe 5" to the second channel 32" roughly the same, so as to alleviate the problem of distribution nonuniformity of the fluid in each tiny fluid channel in the flat pipe 5", thereby improving the heat exchange performance of the heat exchanger.

In addition, the first connecting opening 21" and the bubble-shaped end portion 314" of the first channel 31" are correspondingly arranged, the second connecting opening 22" and the bubble-shaped end portion 324" of the second channel 32" are correspondingly arranged, so that the first channel 31" and the second channel 32" can be arranged flexibly according to positions of the first connecting opening 21" and the second connecting opening 22", thereby enabling the heat exchanger to be applicable in more complicated mounting environments.

Figure 20:
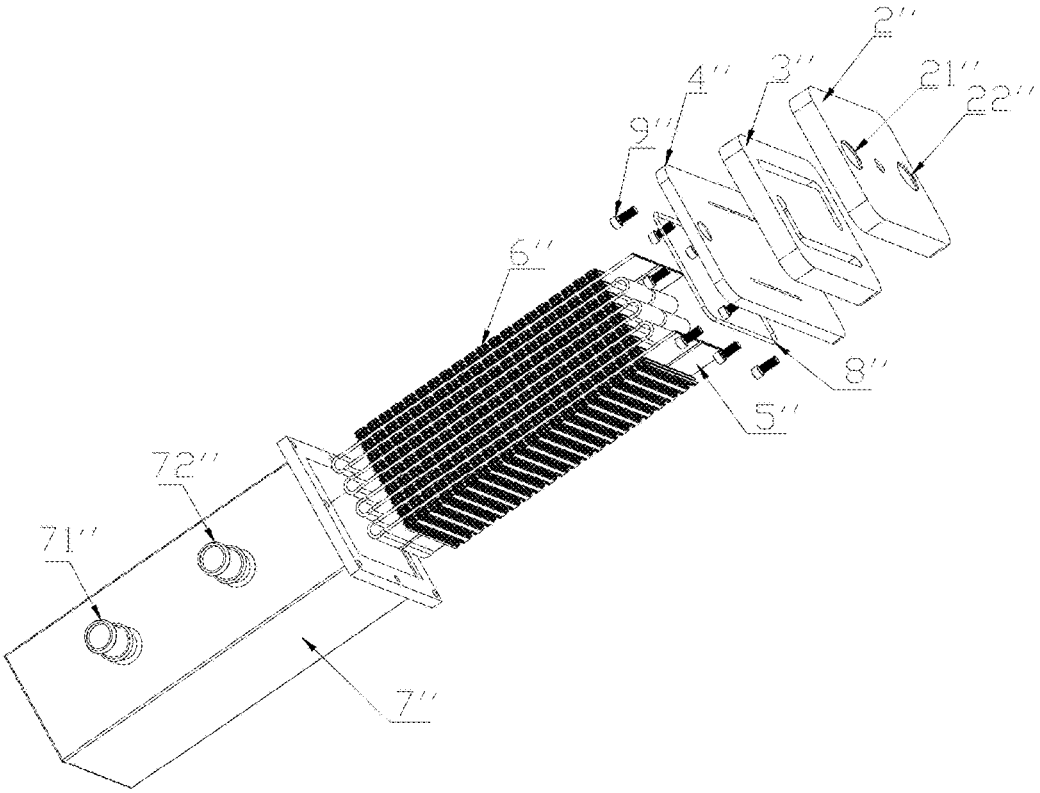
FIG. 20 is an exploded schematic view showing the structure of a heat exchanger according an embodiment of to the present application.
Figure 22:
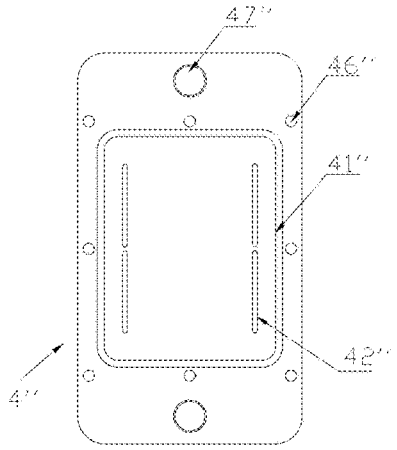
FIG. 22 is a schematic view showing the structure of a mounting plate of the heat exchanger in FIG. 20.

As shown in FIGS. 20 and 22, the mounting plate 4" is provided with a second socket hole 42" penetrating through the mounting plate 4". The flat pipe 5" is in a clearance fit with the second socket hole 42", the ends of the flat pipe 5" can pass through the second socket hole 42", and the flat pipe 5" and the second socket hole 42" can be fixedly mounted to each other by manners like welding. The first socket hole 33" corresponds to the second socket hole 42", and the flat pipe 5" passes through the second socket hole 42" and the first socket hole 33" in sequence. Similarly, a depth of the second socket hole 42" is larger than or equal to 2 mm.

The mounting plate 4" covers the opening side of the housing 7". In order to improve the sealing performance, a sealing element 8" is arranged between the mounting plate 4" and the housing 7", a sealing element groove 41" and a screw hole 46" both used for mounting the sealing element are arranged at a part of the mounting plate 4" in contact with the housing 7", and the mounting plate 4" can be fixedly mounted to the housing 7" by bolts. The mounting plate 4" is further provided with a mounting hole 47" used for mounting the heat exchanger.

Namely, the connecting block also has the function of the mounting plate, in this case, the connecting block is also provided with a mounting hole and a screw hole, and in this embodiment, the second socked hole is not required to be provided. Of course, the mounting plate can also be arranged at other positions of the housing or be fixedly mounted to other portions of the housing, so as to fix the heat exchanger.

Figure 23:
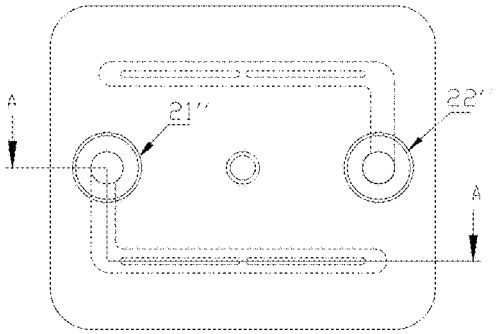
FIG. 23 is a schematic perspective view showing a first mounting plate and a second mounting plate of the heat exchanger in FIG. 20 combined with each other.
Figure 24:
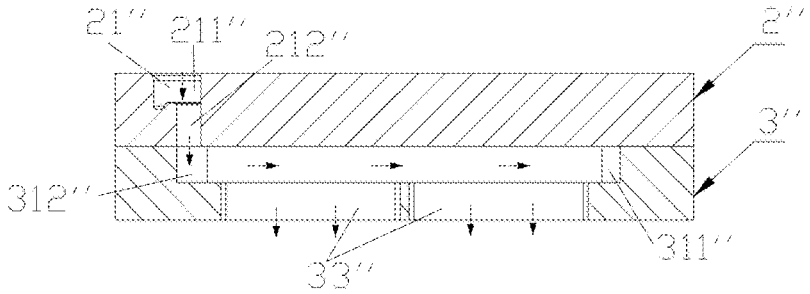
FIG. 24 is a sectional view of FIG. 23 taken along A-A.

As shown in FIGS. 23 and 24, the first connecting opening 21" and the second connecting opening 22" of the first connecting block 2" penetrate through the first connecting block 2". And the first connecting opening 21" and the second connecting opening 22" are stepped holes, both including a small diameter portion close to the second connecting block 3" and a large diameter portion away from the second connecting block 3". As shown in FIG. 24, the first connecting opening 21" includes a large diameter portion 211" and a small diameter portion 212", in which the small diameter portion 212" corresponds to the bubble-shaped end portion 314" of the first channel 31", and an inner diameter or an equivalent diameter of the small diameter portion 212" is roughly or just the same as the inner diameter or the equivalent diameter of the bubble-shaped end portion 314" of the first channel 31". It should be noted that, the first channel 31" and the second channel 32" may also be arranged at a side portion where the first connecting block 2" and the second connecting block 3" contact with each other. In this embodiment, by the way of combining the first connecting block 2", the second connecting block 3" and the mounting plate 4", on the one hand, manufacturing process of each component is relatively less, so as to facilitate the manufacture, on the other hand, the material can be reduced (for example, a thickness of the mounting plate can be relatively small), so as to save the cost.

In this embodiment, by arranging the sealing channels in the first connecting block and/or the second connecting block, not only the pressure-resistance performance is improved and thus deformation is not apt to occur under a high pressure, but also the structure is simple, the manufacture is convenient and the cost is low.

After the flat pipe is bent for several times, two ends of the flat pipe extend into the first channel 31" and the second channel 32" through the first socket hole 33' and the second socket hole 42", so that the first connecting opening 21" and the second connecting opening 22" are in communication through the second connecting opening 22".

Figure 25:
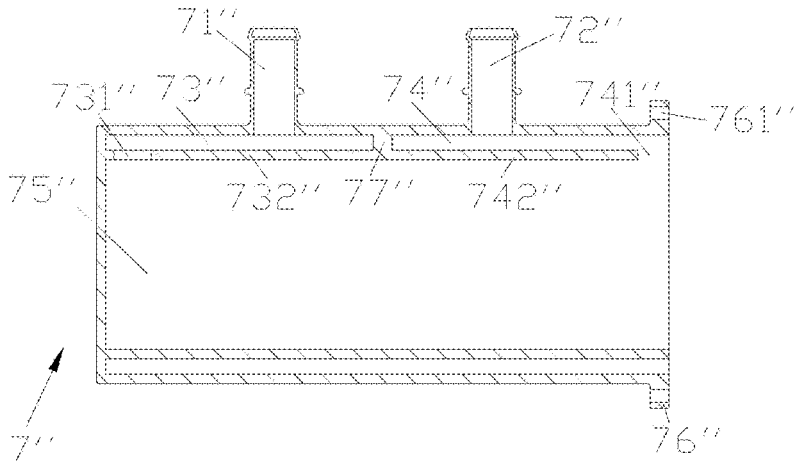
FIG. 25 is a schematic sectional view showing a housing of the heat exchanger in FIG. 20.
Figure 26:
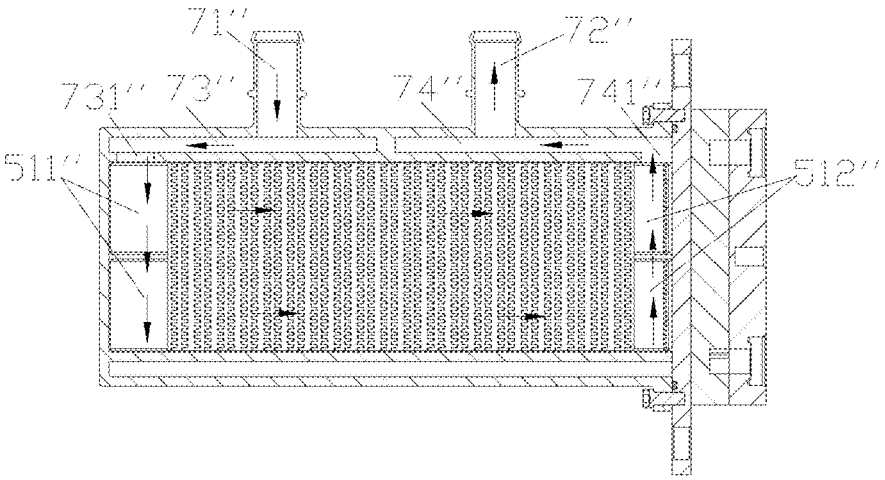
FIG. 26 is a sectional view of the heat exchanger in FIG. 20 sectioned at a third connecting opening and a fourth connecting opening.
Figure 27:
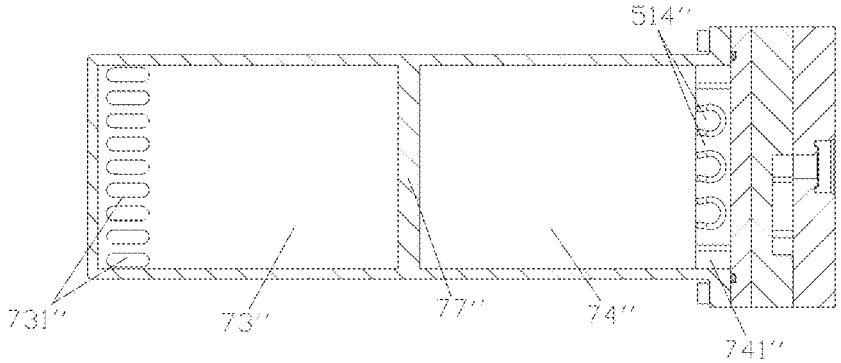
FIG. 27 is a sectional view at a position of a first chamber and a second chamber of the heat exchanger in FIG. 20.

In this embodiment, the housing 7" includes an outer housing 701" and a separating element 702", where the outer housing 701" and the separating element 702" both may be an integrally injection molded part or an integral casting part, and can be integrally processed with a material chosen according to the property of the fluid in the first fluid channel and the application environment. As shown in FIGS. 25 to 27, the separating element 702" is arranged inside the outer housing 701", and a first chamber 73", second chamber 74" and a third chamber 75" are formed in the housing 7". The first chamber 73" is in communication with the third connecting opening 71", and the second chamber 74" is in communication with the fourth connecting opening 72". The separating element 702" includes a first separating wall 77", a first wall portion 732" and a second wall portion 742". The first separating wall 77" is arranged between the first chamber 73" and the second chamber 74", and the first chamber 73" is not directly in communication with the second chamber 74". Besides, an end of the second chamber 74" is arranged to be an opening, an end of the third chamber 75" is arranged to be an opening, and a direction of the opening of the second chamber 74" is the same as a direction of the opening of the third chamber 75".

The first wall portion 732" is arranged between the first chamber 73" and the third chamber 75", and the second wall portion 742" is arranged between the second chamber 74" and the third chamber 75". A first communicating hole 731" is arranged at the first wall portion 732" corresponding to the third connecting opening 71", the first chamber 73" is in communication with the third chamber 75" through the first communicating hole 731". A second communicating hole 741" is arranged at the second wall portion 742" corresponding to the fourth connecting opening 72", and the second chamber 74" is in communication with the third chamber 75" through the second communicating hole 741".

A projection of the third connecting opening 71" on the first wall portion 732" does not interfere with the first communicating hole 731", and a projection of the fourth connecting opening 72" onto the second wall portion 742" does not interfere with the second communicating hole 741'. A projection of a first finless region 511" onto the first wall portion 732" is partially coincident with or totally coincident with the first communicating hole 731", and a projection of fins 6" onto the first wall portion 732" is not coincident with the first communicating hole 731". A projection of a second finless region 512" onto the second wall portion 742" is partially coincident with or totally coincident with the second communicating hole 741", and a projection of fins 6" onto the second wall portion 742" is not coincident with the second communicating hole 741".

Besides, the first communicating hole 731 includes a plurality of small communicating holes having relatively small through diameters, and each of the small communicating holes corresponds to at least one first through-flow region 513", that is, a projection of each first through-flow region 513" onto the first wall portion 732" is located at a small communicating hole. In this way, as shown by an arrow in FIG. 27, in a case that the third connecting opening 71" serves as an inlet of the first fluid, after flowing from the third connecting opening 71" to the first chamber 73", the first fluid can relatively evenly flow to each first through-flow region 513" through each small communicating hole, then passes through the fins 6" and the second through-flow region 514" and flows into the second chamber 74", and flows out of the heat exchanger through the fourth connecting opening 72". Such an arrangement facilitates the improvement of the heat exchange performance of the heat exchanger.

Of course, the second communicating hole 741" may be provided with a plurality of small communicating holes having relatively small through diameters.

An extension portion 76" is arranged at the opening side of the housing 7", and the extension portion 76" is provided with multiple screw holes 761'. The screw holes 761" match with the screw holes 46" of the mounting hole, the housing 7" and the mounting plate 6" are fixedly mounted by bolts 9" and are seal-fixed by the sealing element 8".

Figure 28:
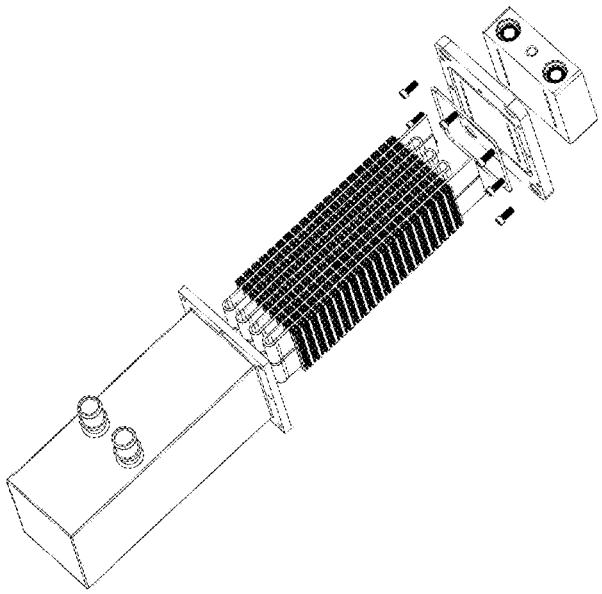
FIG. 28 is an exploded schematic view showing the structure of a heat exchanger according to another embodiment of the present application.
Figure 29:
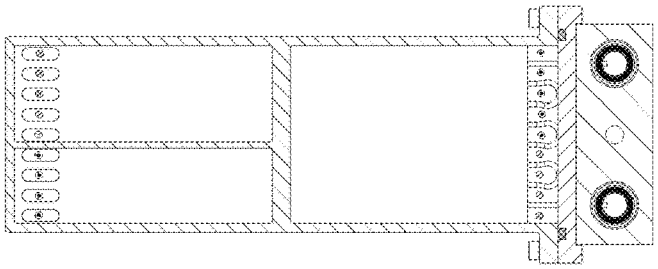
FIG. 29 is a schematic sectional view showing the heat exchanger in FIG. 28.

Of course, an arrangement as shown in FIGS. 28 and 29 is also feasible, so that a flowing direction of at least a part of the first fluid in the length direction of the flat pipe is contrary to a flowing direction of the other part of the first fluid in the length direction of the flat pipe, and details can be referred to the embodiments shown in FIGS. 14 to 19, which are not be described herein.

The above embodiments are only specific embodiments of the present application, and are not intended to limit the present application in any form. Although the present application is disclosed hereinabove by the preferred embodiments, the preferred embodiments are not used to limit the present application. It should be understood by the skilled in the art that, many possible variations and modifications, or equivalent embodiments modified as equivalent variations, may be made to the technical solution of the present application based on the above disclosed technical contents without departing from the scope of the technical solution of the present application. Therefore, any simple variations, equivalent variations and modifications, made to the above embodiments according to the technical essence of the present application without departing from the content of the technical solution of the present application, are also deemed to fall into the scope defined by the technical solution of the present application.

What is claimed is:

1. A heat exchanger, comprising a case body, and a heat exchange core accommodated in the case body, wherein:

a first fluid channel is formed in the case body, a second fluid channel is formed in the heat exchange core, and the first fluid channel and the second fluid channel are isolated from each other, the heat exchange core comprises one or more flat pipes, the second fluid channel is located in the flat pipe, and the flat pipe comprises at least one first bending portion, at least one second bending portion and a plurality of flat straight portions, the first bending portion and the second bending portion are located at two opposite sides of the heat exchange core respectively, the adjacent two flat straight portions are roughly parallel with each other and keeps a distance of 0.5 mm to 6 mm from each other;

the case body is provided with an opening in communication with a space close to the first bending portion, a projection of the first bending portion and/or a part of the flat straight portions close to the first bending portion in a direction of an inner wall of the case body is at least partially coincident with the opening; and the case body is provided with an opening in communication with a space close to the second bending portion, a projection of the second bending portion and/or a part of the flat straight portions close to the second bending portion in a direction of an inner wall of the case body is at least partially coincident with the opening.

2. The heat exchanger according to claim 1, wherein the case body is provided with a first hole and a second hole both in communication with outside, the first hole is the opening provided at the case body and in communication with the space close to the first bending portion, the projection of the first bending portion and/or the part close to the first bending portion of the flat straight portions in the direction of the inner wall of the case body is at least partially coincident with the first hole or an opening of the first hole at the case body; and the second hole is the opening provided at the case body and in communication with the space close to the second bending portion, the projection of the second bending portion and/or the part close to the second bending portion of the flat straight portions in the direction of the inner wall of the case body is at least partially coincident with the second hole or an opening of the second hole at the case body.

3. The heat exchanger according to claim 2, wherein a minimum distance between adjacent two first bending portions or adjacent two second bending portions is greater than zero; the first bending portion comprises a plurality of sections of circular arcs connected smoothly, the first bending portion comprises a main bending portion, a first subsidiary bending portion and a second subsidiary bending portion, an end of the first subsidiary bending portion and an end of the second subsidiary bending portion at a same side are connected to two adjacent flat straight portions respectively, the main bending portion is located between the first subsidiary bending portion and the second subsidiary bending portion, and a radius R1 of a circular arc of the main bending portion and a distance d2 between two adjacent flat straight portions meet a relationship: $R1<d2<2R2$.

4. The heat exchanger according to claim 2, wherein the first bending portion comprises a main bending portion and a subsidiary bending portion, two ends of the subsidiary bending portion are connected to the main bending portion and the flat straight portion, and two ends of the main bending portion are connected to the first subsidiary bending portion and the flat straight portion, an end of the main bending portion connected to the flat straight portion is tangent to the flat straight portion, and a diameter of the circular arc of the main bending portion is larger than the distance between two adjacent flat straight portions.

5. The heat exchanger according to claim 1, wherein fins are arranged between two adjacent flat straight portions of the flat pipe, the fins are fixed to the flat pipe, and parts of the fins in contact with an inner wall of the case body are fixed to the inner wall of the case body, an end of the fins close to the first bending portion keeps a distance of 5 mm to 30 mm from the first bending portion, at least a part of an end of the flat straight portion close to the first bending portion is not provided with the fins, a projection of the part of the flat straight portion being not provided with the fins in the direction of the inner wall of the case body is at least partially coincident with the first hole, wherein the inner wall corresponds to the first hole.

6. The heat exchanger according to claim 5, wherein the case body comprises a main case body, a first cover plate, a first distributing plate and a second cover plate, an opening end is arranged at each of two sides of the main case body, the two sides where the two opening ends are located are arranged adjacently, and the main case body is seal-fixed to the second cover plate, the distributing plate and the first cover plate are arranged at another opening end from inside out starting from the main case body, at least one distributing hole and at least one converging hole are arranged at the distributing plate, and the distributing hole is the first hole, the converging hole is the second hole; and the distributing hole matches with the first cover plate, a first surface of the distributing plate opposite to the first cover plate is basically fitted and seal-fixed to a periphery of the first covet plate, a first chamber and a second chamber are formed between the distributing plate and the first cover plate, the first chamber and the second chamber are isolated from each other, the first chamber is in communication with the distributing hole, and the second chamber is in communication with the converging hole.

7. The heat exchanger according to claim 1, wherein the case body comprises a main case body, a first cover plate and a distributing plate, an opening end is arranged at a side of the main case body, the distributing plate and the first cover plate are fixed at the opening end in sequence from inside out, starting from the main case body, and at least one distributing hole and at least one converging hole are arranged at the distributing plate, and the distributing hole is the first hole, the converging hole is the second hole; and the distributing hole matches with the first cover plate, a first surface of the distributing plate facing the first cover plate is basically attached and seal-fixed to a periphery of the first covet plate, a first chamber and a second chamber are formed between the distributing plate and the first cover plate, the first chamber and the second chamber are isolated from each other, the first chamber is in communication with the distributing hole, and the second chamber is in communication with the converging hole.

8. The heat exchanger according to claim 1 wherein a minimum distance between two adjacent first bending portions or two adjacent second bending portions is greater than zero, the two adjacent first bending portions are arranged in a staggered manner, the two adjacent second bending portions are arranged in a staggered manner, and the minimum distance between two adjacent first bending portions is larger than a minimum distance between the first bending portion and the flat straight portion which are adjacent, the minimum distance between two adjacent second bending portions is greater than a minimum distance between the second bending portion and the flat straight portion which are adjacent.

9. The heat exchanger according to claim 1 wherein the case body comprises a main case body, a distributing plate and a cover plate, an opening portion is arranged at a side of the main case body, the distributing plate is fixedly arranged to the opening portion of the main case body, and the distributing plate is fixedly arranged to the cover plate; and the cover plate comprises a first connecting opening and a second connecting opening, the first connecting opening and the second connecting opening are in communication with the first fluid channel, the distributing plate comprises one or more first communicating portions, one or more second communicating portions, and one or more third communicating portions, the first communicating portion and the second communicating portion are relatively close to the first bending portion and in communication with a space close to the first bending portion, and the third communicating portion is relatively close to the second bending portion and in communication with a space close to the second bending portion, at least three chambers are formed between the cover plate and the distributing plate, and the chambers are isolated from one another, the chambers comprises a first chamber, a second chamber and a third chamber, the first chamber is in communication with the first communicating portion, the second chamber is in communication with the second communicating portion, and the third chamber is in communication with the third communicating portion, the first connecting opening is in communication with the first chamber, and the second connecting opening is in communication with the second chamber.

10. The heat exchanger according to claim 1 wherein the case body comprises a cover body portion and a main body portion, the cover body portion comprises a first chamber, a second chamber and a third chamber, which are isolated from one another, a first side of the cover body portion comprises a first connecting opening and a second connecting opening, a second side of the cover body portion comprises one or more first communicating portions, one or more second communicating portions, and one or more third communicating portions, the first connecting opening is in communication with the first chamber, the one or more first communicating portions are in communication with the first chamber, the second connecting opening is in communication with the second chamber, the one or more second communicating portions are in communication with the second chamber, the second side of the cover body portion is fixed to the main body portion, and the third communicating portion is in communication with the third chamber; and the main body portion of the case body comprises at least two heat exchange regions, and the heat exchange regions comprises a first heat exchange region and a second heat exchange region, one side of the first heat exchange region is in communication with the first communicating portion, and another side of the first heat exchange region is in communication with a part of the third communicating portion, one side of the second heat exchange region is in communication with the second communicating portion, and another side of the second heat exchange region is in communication with another part of the third communicating portion; a part of the third communicating portion is in communication with the third chamber, another part of the third communicating portions is in communication with the third chamber.

11. The heat exchanger according to claim 1 wherein the case body comprises a main case body and a cover body, wherein the cover body comprises a first connecting opening, a second connecting opening, at least two chambers and at least two communicating portions, the chambers comprise a first chamber and a second chamber, and the chambers are isolated from each other; the communicating portions comprise a first communicating portion and a second communicating portion, the first connecting opening is in communication with the first chamber, the first communication portion is in communication with the first chamber; the second connecting opening is in communication with the second chamber, the second communication portion is in communication with the second chamber; the first communication portion and the second communication portion are in communication with the first fluid channel, the main case body is provided with an opening end, the cover body is fixedly arranged to the opening end of the main case body; a lateral portion of the main case body is provided with a groove, a part of the flat pipe passes through the groove, and a distance L1 between the first bending portion and the first end portion or the second end portion is smaller than or equal to a distance L0 between inner walls of the case body.

12. The heat exchanger according to claim 1 wherein the case body comprises a main body portion, an isolating portion, a first cover body and a second cover body, wherein the main body portion is fixedly arranged to the first cover body, and the main body portion is fixedly arranged to the second cover body, the first cover body is located at one side of the isolating portion, and the second cover body is located at another side of the isolating portion, the first fluid channel is defined by the first cover body, the second cover body and the main body portion, the first cover body comprises a first connecting opening, one or more first communicating portions and a first chamber, the first connecting opening is in communication with the first chamber, and the first communicating portion is in communication with the first chamber; the second cover body comprises a second connecting opening, one or more second communicating portions and a second chamber, the second connecting opening is in communication with the second chamber, and the second communicating portion is in communication with the second chamber;

the flat pipes comprise a first flat pipe and a second flat pipe, the first flat pipe and the second flat pipe are arranged at two sides of the isolating portion respectively, a first circulating region is formed between the isolating portion and the first cover body, a second circulating region is formed between the isolating portion and the second cover body, and the first circulating region and the second circulating region are part of the first fluid channel, the first circulating region is in communication with the first communicating portion, the second circulating region is in communication with the second communicating portion, the heat exchanger further comprises a communicating opening through which the first circulating region and the second circulating region are in communication.

13. The heat exchanger according to claim 1 wherein the heat exchanger further comprises a connecting block, and the connecting block is provided with a first channel, a second channel, a first connecting opening in communication with the first channel and a second connecting opening in communication with the second channel;

the connecting block is further provided with a first socket hole of the first channel which corresponds to the first channel, and a first socket hole of the second channel which corresponds to the second channel, the heat exchange core comprises at least one flat pipe, and at least a part of the first fluid channel is located in the flat pipe, at least a part of an end of the flat pipe extends into the first socket hole of the first channel and is seal-mounted to the first socket hole of the first channel, and the first channel is in communication with the first fluid channel of the flat pipe; at least a part of another end of the flat pipe extends into the first socket hole of the second channel and is seal-mounted with the first socket hole of the second channel, and the second channel is in communication with the first fluid channel of the flat pipe.

14. The heat exchanger according to claim 1, wherein the housing comprises an outer housing and a separator, the separator is arranged inside the outer housing such that a first chamber, a second chamber and a third chamber are formed in the housing, the separator comprises a first separating wall, a first wall portion and a second wall portion, the first wall portion is located between the first chamber and the third chamber, the second wall portion is located between the second chamber and the third chamber, and the first separating wall is located between the first chamber and the second chamber, the first wall portion is provided with a first communicating hole, and the first chamber is in communication with the third chamber through the first communicating hole; the second wall portion is provided with a second communicating hole, and the second chamber is in communication with the third chamber through the second communicating hole.

15. The heat exchanger according to claim 2, wherein fins are arranged between two adjacent flat straight portions of the flat pipe, the fins are fixed to the flat pipe, and parts of the fins in contact with an inner wall of the case body are fixed to the inner wall of the case body, an end of the fins close to the first bending portion keeps a distance of 5 mm to 30 mm from the first bending portion, at least a part of an end of the flat straight portion close to the first bending portion is not provided with the fins, a projection of the part of the flat straight portion being not provided with the fins in the direction of the inner wall of the case body is at least partially coincident with the first hole, wherein the inner wall corresponds to the first hole.

16. The heat exchanger according to claim 3, wherein fins are arranged between two adjacent flat straight portions of the flat pipe, the fins are fixed to the flat pipe, and parts of the fins in contact with an inner wall of the case body are fixed to the inner wall of the case body, an end of the fins close to the first bending portion keeps a distance of 5 mm to 30 mm from the first bending portion, at least a part of an end of the flat straight portion close to the first bending portion is not provided with the fins, a projection of the part of the flat straight portion being not provided with the fins in the direction of the inner wall of the case body is at least partially coincident with the first hole, wherein the inner wall corresponds to the first hole.

17. The heat exchanger according to claim 4, wherein fins are arranged between two adjacent flat straight portions of the flat pipe, the fins are fixed to the flat pipe, and parts of the fins in contact with an inner wall of the case body are fixed to the inner wall of the case body, an end of the fins close to the first bending portion keeps a distance of 5 mm to 30 mm from the first bending portion, at least a part of an end of the flat straight portion close to the first bending portion is not provided with the fins, a projection of the part of the flat straight portion being not provided with the fins in the direction of the inner wall of the case body is at least partially coincident with the first hole, wherein the inner wall corresponds to the first hole.

* * * * *